US005293906A

United States Patent [19]

Amin

[11] Patent Number: 5,293,906

[45] Date of Patent: Mar. 15, 1994

[54] CIRCULAR LOOM FOR AND METHOD OF WEAVING RIBBON-SHAPED WEFT

[75] Inventor: Suresh K. Amin, Northborough, Mass.

[73] Assignee: Quadrax Corporation, Portsmouth, R.I.

[21] Appl. No.: 990,928

[22] Filed: Dec. 14, 1992

Related U.S. Application Data

[63] Continuation of Ser. No. 668,334, Mar. 14, 1991, abandoned, which is a continuation of Ser. No. 451,345, Dec. 18, 1989, abandoned.

[51] Int. Cl.[5] ..... D03D 37/00

[52] U.S. Cl. ..... 139/458; 139/436; 139/459; 139/309

[58] Field of Search ..... 139/436, 458, 457, 459, 139/309, 16, 291 R, 15, 14, 455, 456, 11, DIG. 1

[56] References Cited

U.S. PATENT DOCUMENTS

| | | | |
|---|---|---|---|
| 1,495,311 | 5/1924 | Stuer . | |
| 1,694,254 | 12/1928 | Frederickson . | |
| 1,872,168 | 8/1932 | Nanfeldt | 139/457 |
| 2,168,385 | 8/1939 | Baumgarten . | |
| 2,454,146 | 11/1948 | Ezbelent . | |
| 3,719,210 | 3/1973 | Emerson et al. | 139/457 |
| 3,871,413 | 3/1975 | Torii | 139/459 |
| 4,273,162 | 6/1981 | Bosse | 139/459 |
| 4,365,651 | 12/1982 | Torii | 139/458 |
| 4,424,836 | 1/1984 | Torii | 139/457 |
| 4,479,517 | 10/1984 | Plammer et al. | 139/458 |
| 4,509,562 | 4/1985 | Schonberger et al. | 139/457 X |
| 4,658,862 | 4/1987 | Huemer | 139/457 |
| 4,763,699 | 8/1988 | Corain et al. | 139/436 |
| 4,977,933 | 12/1990 | Brais | 139/459 |

FOREIGN PATENT DOCUMENTS

| | | | |
|---|---|---|---|
| 249158 | 9/1987 | German Democratic Rep. | 139/436 |

*Primary Examiner*—Andrew M. Falik

*Attorney, Agent, or Firm*—Jacobson, Price, Holman & Stern

[57] ABSTRACT

A circular loom comprises weft ribbon shuttle assemblies and a control system for detecting the position of one of the shuttle assemblies at spaced points about the periphery of the loom, and then presetting warp ribbon-setting air cylinders in advance of each of the shuttle assemblies for subsequent passage of the shuttle assemblies through the resultant warp sheds without engaging the warp ribbons. Electrical brakes control warp and weft tension in a uniform manner. The shuttle assemblies are driven by a gearing from a motor mounted independently of the shuttle assemblies. In a fabric-forming position, each weft ribbon slides transversely under a fabric-forming ring with the longitudinally moving warp shed and into the plane of the formed fabric in engagement with an annular inner surface of the ring, essentially without any twist about a transverse axis of the weft. Pulling of the formed fabric from the fabric-forming ring is controlled by synchronizing speed of a fabric-pulling mechanism with the speed of the shuttle assembly drive motor, at a rate dependent upon the width of the weft ribbons. Prior to reaching the fabric-pulling mechanism, the tubular fabric is slit longitudinally and finally is wound upon a take-up reel in an essentially relaxed condition without any significant tension in the fabric. The loom is preprogrammed for a plurality of different weave patterns, each of which can readily be selected by operation of a respective switch on a control console.

91 Claims, 12 Drawing Sheets

FIG. 5
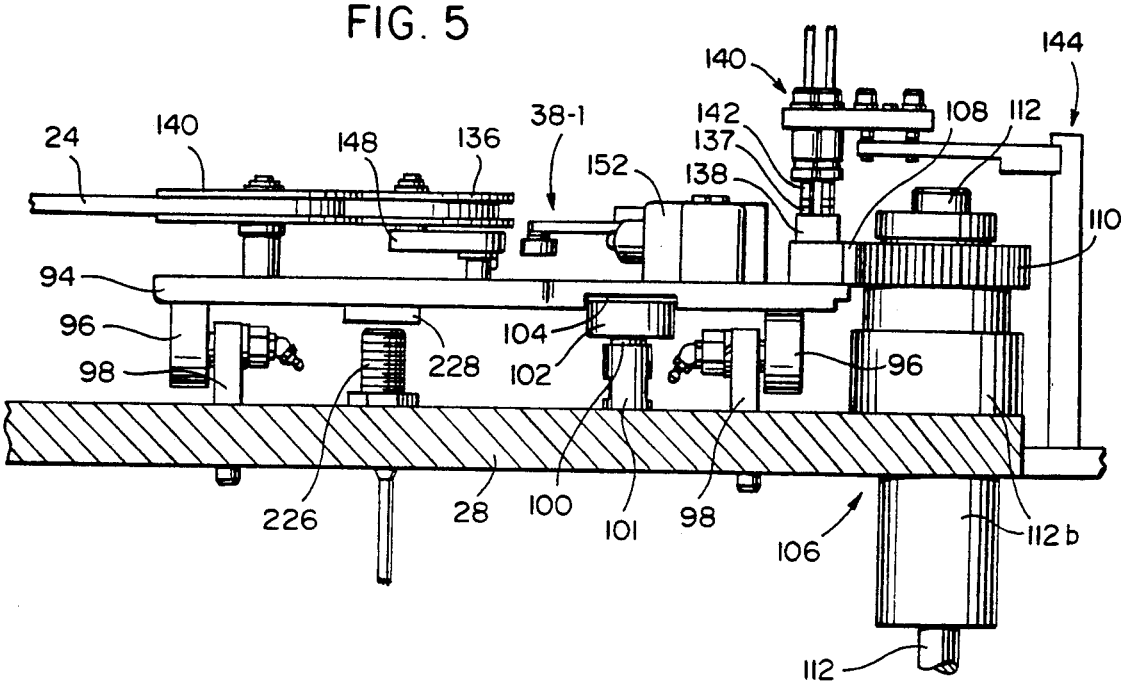
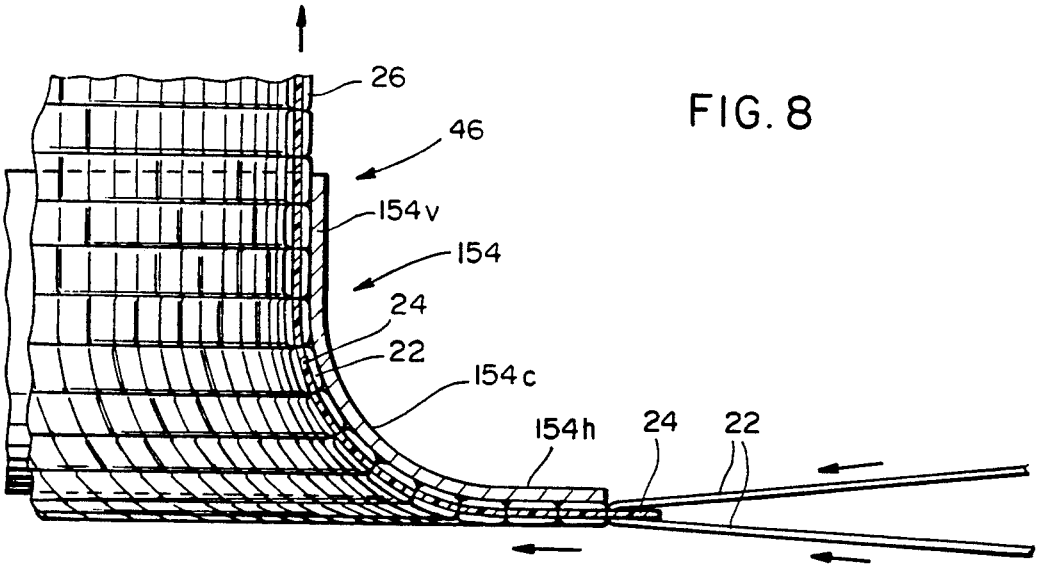
FIG. 8

FIG. 9
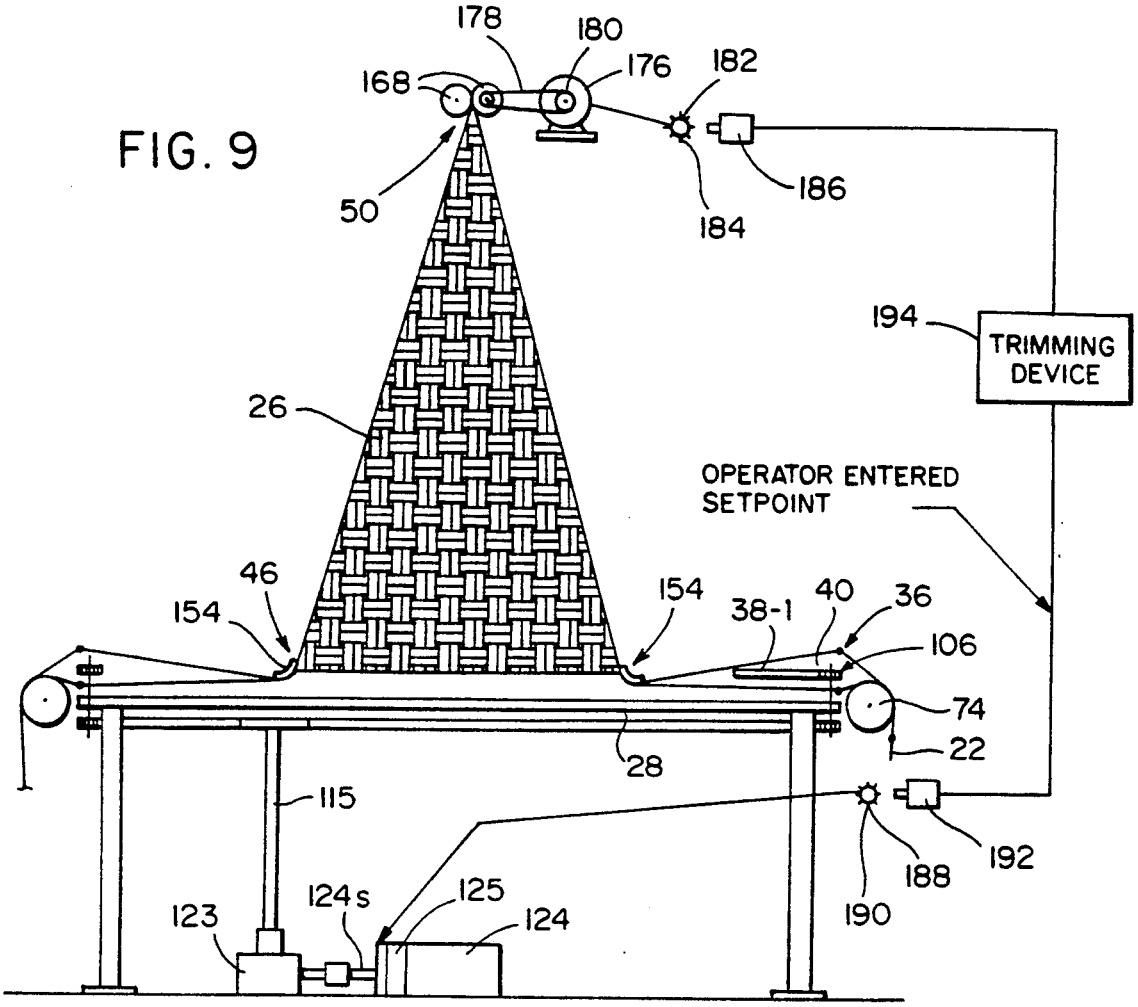
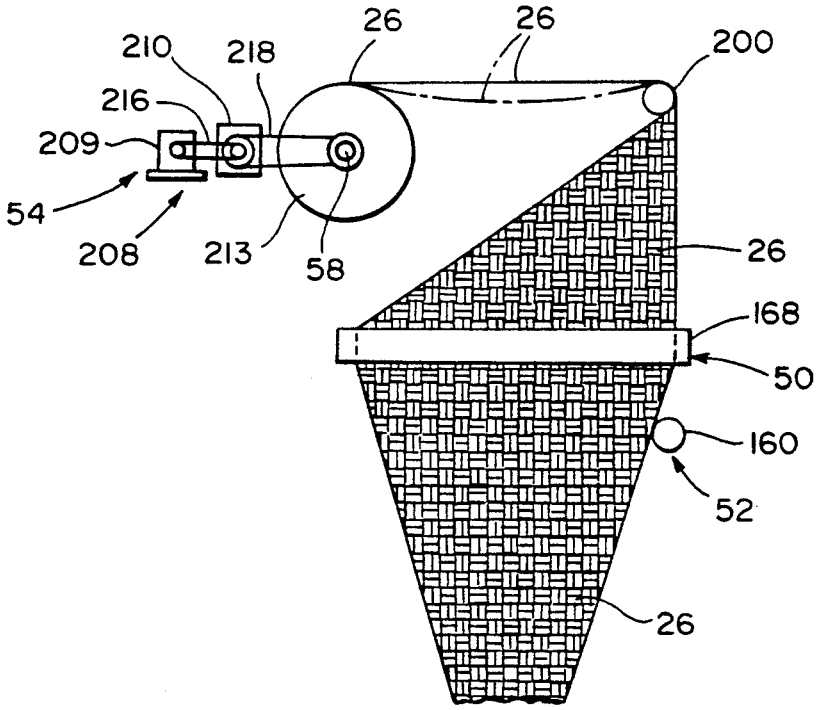
FIG. 10

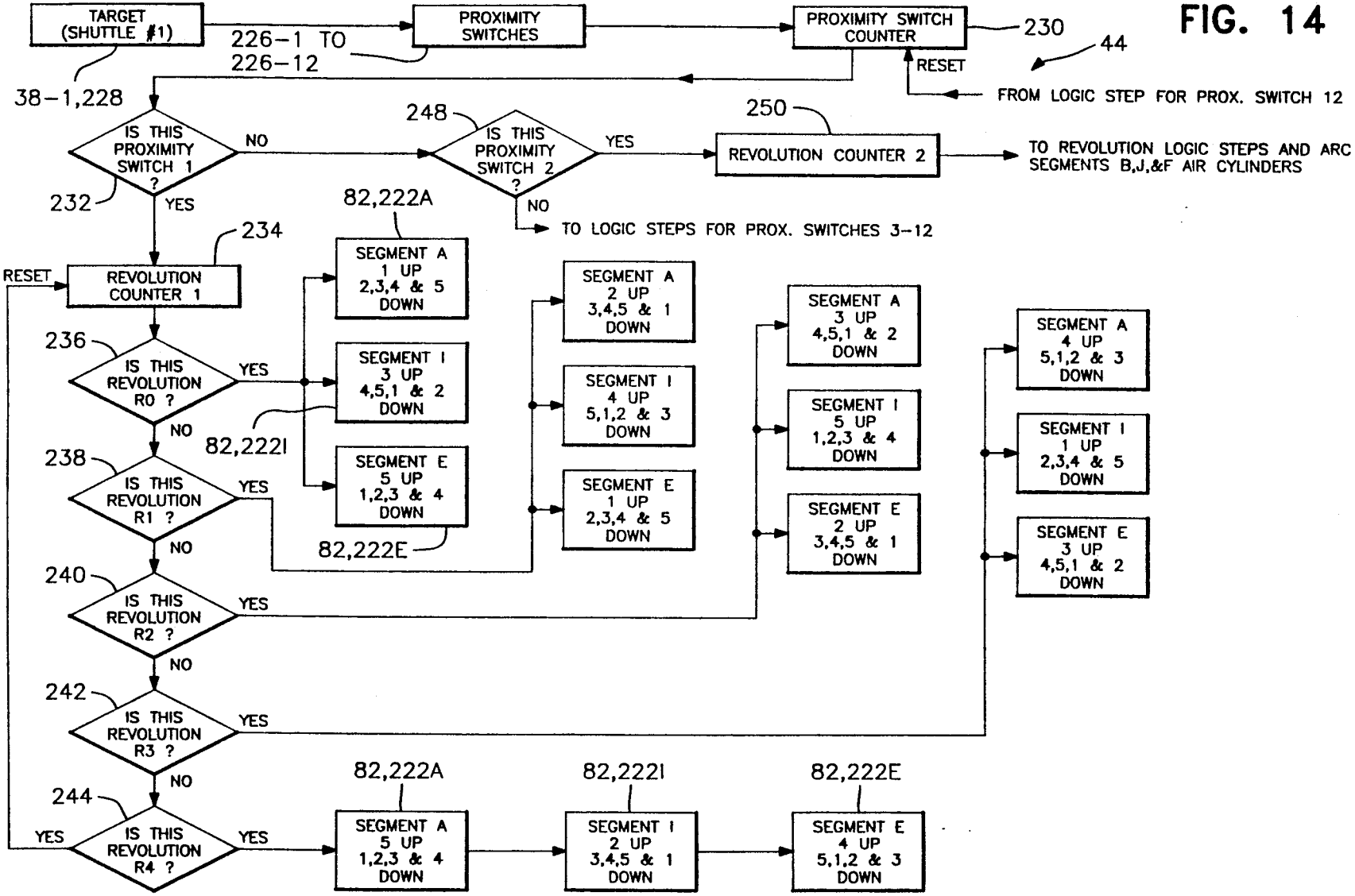
FIG. 14
TARGET (SHUTTLE #1)
38-1,228
PROXIMITY SWITCHES
226-1 TO 226-12
PROXIMITY SWITCH COUNTER
230
RESET
44
FROM LOGIC STEP FOR PROX. SWITCH 12
IS THIS PROXIMITY SWITCH 1 ?
232
NO
YES
IS THIS PROXIMITY SWITCH 2 ?
248
NO
YES
REVOLUTION COUNTER 2
250
TO REVOLUTION LOGIC STEPS AND ARC SEGMENTS B,J,&F AIR CYLINDERS
TO LOGIC STEPS FOR PROX. SWITCHES 3-12
REVOLUTION COUNTER 1
234
RESET
IS THIS REVOLUTION R0 ?
236
IS THIS REVOLUTION R1 ?
238
IS THIS REVOLUTION R2 ?
240
IS THIS REVOLUTION R3 ?
242
IS THIS REVOLUTION R4 ?
244
SEGMENT A 1 UP 2,3,4 & 5 DOWN
82,222A
SEGMENT I 3 UP 4,5,1 & 2 DOWN
82,222I
SEGMENT E 5 UP 1,2,3 & 4 DOWN
82,222E
SEGMENT A 2 UP 3,4,5 & 1 DOWN
SEGMENT I 4 UP 5,1,2 & 3 DOWN
SEGMENT E 1 UP 2,3,4 & 5 DOWN
SEGMENT A 3 UP 4,5,1 & 2 DOWN
SEGMENT I 5 UP 1,2,3 & 4 DOWN
SEGMENT E 2 UP 3,4,5 & 1 DOWN
SEGMENT A 4 UP 5,1,2 & 3 DOWN
SEGMENT I 1 UP 2,3,4 & 5 DOWN
SEGMENT E 3 UP 4,5,1 & 2 DOWN
SEGMENT A 5 UP 1,2,3 & 4 DOWN
82,222A
SEGMENT I 2 UP 3,4,5 & 1 DOWN
82,222I
SEGMENT E 4 UP 5,1,2 & 3 DOWN
82,222E

CIRCULAR LOOM FOR AND METHOD OF WEAVING RIBBON-SHAPED WEFT

This application is a continuation of application Ser. No. 07/668,334, filed Mar. 14, 1991, abandoned, which is a continuation of application Ser. No. 07/451,345, filed Dec. 18, 1989, abandoned.

BACKGROUND OF THE INVENTION

1. Field of the Invention

This invention relates to a circular loom for and method of weaving ribbon-shaped materials, and more specifically to a circular loom for and method of weaving ribbon-shaped materials wherein the material is formed by interlacing multi-directional, fiber-reinforced plastic tapes or ribbons, and wherein the circular loom is of simplified, high-speed construction which is capable of forming the material with a tight uniform weave, without twisting or stretching of the warp and/or weft, and which readily can be converted to form a desired weave pattern selected from a large number of possible weave patterns.

2. Description of the Prior Art

Co-pending U.S. patent application Ser. No. 07/314,232, now U.S. Pat. No. 4,977,933 which is a continuation of U.S. patent application Ser. No. 06/738,461, filed May 28, 1985, abandoned and which is exclusively licensed to the assignee of the subject application, discloses a circular loom for weaving flat, strip-like, or ribbon-shaped material into fabric. In this circular loom, the weft carrier or shuttle assembly travels in a circular path and includes a body member carrying a weft supply, a motive power mechanism and a warp shed forming mechanism. A cam mechanism activated by the rotating body member orients entering warp ends in advance of the weft carrier or shuttle assembly into positions for weaving a desired fabric pattern. Other circular looms of this general type are shown in U.S. Pat. No. 1,495,311 to J. Stuer, U.S. Pat. No. 1,694,254 to O. A. Fredrickson, U.S. Pat. No. 2,168,385 to I. Baumgarten, U.S. Pat. No. 2,454,146 to G. E. Ezbelent, U.S. Pat. No. 3,719,210 to P. D. Emerson et al and U.S. Pat. Nos. 3,871,413 and 4,365,651, to S. Torii.

With specific reference to the above-mentioned co-pending U.S. patent application Ser. No. 07/314,232, U.S. Pat. No. 4,977,933 over which the subject application represents an improvement, the motive power mechanism on the shuttle assembly includes a motor which drives a sprocket wheel mounted on the shuttle. The sprocket wheel directly makes contact with spaced rods which are mounted about the periphery of a loom support table and which are further adapted to space the entering warp ends. Setting of the warp ends for a preselected weave pattern is created by a plurality of sets of disks also mounted about the periphery of the loom support table, with the disks in each set being adapted to rotate together on a common axis in a spaced apart relationship, so as to receive the warp ends therebetween, and with at least one pair of disks in each set having at least one warp end supporting member bridging the peripheries of the pair of disks. When a different weave pattern is required, the positions of the warp end supporting members are changed as may be necessary.

Final forming of the warp shed in the abovementioned U.S. patent application Ser. No. 07/314,232 is accomplished by a first pointed member on the outer side of the shuttle assembly, and a second pointed member on the inner side of the shuttle assembly, engaging between the warp ends as spaced by the rotatable disks, as the shuttle assembly travels around the support table. Control of the diameter of the resultant formed tubular fabric is dependent upon a preset constant weft tension to overcome the warp tension, which is created by weights, and in guiding the weft ribbon into the warp shed about a ring-shaped guide member with a horizontal-to-vertical plane twist. More specifically, the weft approaches the ring-shaped guide member with the plane of the weft horizontally disposed, and then travels under a lower side of the guide member and turns into a vertically disposed planar position in engagement with an annular inner side of the guide member, with a twist of essentially 90°. The formed tubular fabric subsequently is pinched together at an upper end to form a dual layer of fabric, after which the fabric is pulled upwardly by and through pull rolls at a pulling speed which is achieved in a timed sequence to the speed of the shuttle assembly, by virtue of a solenoid operated pawl and ratchet mechanism. The tubular fabric then is slit and wound upon one or more take-up rolls also actuated in timed relationship to the pull rolls and the rate of weaving.

While the above described circular loom has been found to be useful in the interlacing of ribbon-shaped material under certain conditions, it has not proven to be entirely satisfactory in the interlacing of ribbon-shaped materials of substantial width (e.g., up to three inches or more) at high speed and with a tight uniform weave, without twisting or stretching of the warp and/or weft, and/or where the same loom is intended to be used in the interlacing of a number of possible weave patterns. Accordingly, a primary purpose of this invention is to provide a circular loom having these capabilities.

SUMMARY OF THE INVENTION

In general, a circular loom for weaving warp and weft to form a fabric comprises a support table having a plurality of supplies of warp arranged around its periphery, and a guide mechanism for guiding warp ends from the warp supplies to a fabric-forming position. A warp shed-forming mechanism is also arranged around the periphery of the support table for orienting the warp ends extending from the warp supplies to the fabric-forming position relative to one another to form a series of warp sheds corresponding to a preselected weave pattern. A shuttle assembly is mounted for movement in a circular path on the support table through the warp sheds and includes a supply of weft which is laid between the oriented warp ends in the fabric-forming position as the shuttle assembly travels about the table. A drive mechanism rotates the shuttle assembly along the circular path on the support table and a guide mechanism guides the weft from the weft supply as the weft travels to the fabric-forming position. A control system is provided for detecting the position of the shuttle assembly at periodic points along its path of travel and sequentially presetting banks of warp setting devices of the warp shed-forming mechanism in advance of the shuttle assembly for subsequent passage of the shuttle assembly therethrough.

More specifically, a plurality of shuttle assemblies are rotatable about the support table, and the position of one of the shuttle assemblies is used as a control for the presetting of the warp sheds for all of the shuttle assemblies simultaneously. Further, the warp setting devices of the warp shed-forming mechanism are fluid cylinders which include extendable and retractable piston rods having warp guides mounted thereon, with the piston rods being extendable and retractable so as to form warp sheds so that the shuttle assemblies travel through the warp sheds without engaging the warp ends. The control system includes a plurality of solenoids for operating respective ones of the fluid cylinders, a plurality of solenoid control circuits, one for each of a plurality of selectable weave patterns, and a plurality of selector switches, one for each of the solenoid control systems. Electrical brakes also are provided on each of the warp supplies to control warp tension.

In addition, the shuttle assemblies are driven by a spur gear-pinon gear arrangement and a motor mounted independently of the shuttle assemblies. A weft guide mechanism on each shuttle assembly includes a guide pulley with an electrical brake for controlling weft tension, the electrical brake being connected to an electrical power supply through a potentiometer slip ring-electrical brush arrangement. Each shuttle assembly also includes a weft-break detector mechanism and a guide mechanism for turning the plane of the weft from perpendicular to the circular path on the support table, to parallel thereto, as the weft travels from the shuttle assembly to an annular fabric-forming ring member mounted in the fabric-forming position. At the fabric-forming position, the weft becomes disposed in the warp shed and slides transversely under (or over) the fabric-forming ring with the longitudinally moving warp shed and into the plane of the formed fabric in engagement with an annular inner surface of the ring, without twist. Further, the formed fabric is pulled from the fabric-forming ring by a fabric-pulling mechanism comprising a pulse generating mechanism for synchronizing the speed of the fabric-pulling mechanism with the speed of the shuttle assembly drive motor, at a rate dependent upon the width of the weft ribbon. Prior to reaching the fabric-pulling mechanism, the tubular fabric is slit longitudinally by a cutting mechanism, and after leaving the fabric-pulling mechanism, the fabric is wound upon a take-up reel by a take-up mechanism, the speed of which is controlled so that the fabric is taken up in an essentially relaxed condition without any significant tension in the fabric.

BRIEF DESCRIPTION OF THE DRAWINGS

FIG. 5 is a cross-sectional view taken along the line 5—5 in FIG. 4, illustrating a shuttle assembly support-drive mechanism;

FIG. 8 is a further enlarged cross-sectional view taken along the line 8—8 in FIG. 4, illustrating a fabric-forming position;

FIG. 9 is an elevational schematic view illustrating a shuttle speed-fabric pulling mechanism synchronization system;

FIG. 10 is an elevational schematic view of a fabric take-up mechanism;

FIG. 14 is a flow chart which is generally applicable to the weaving of various types of weave patterns, illustrating a sequence of steps for interlacing the 5-harness interlaced weave pattern shown in FIG. 11 using the warp shed-presetting control system illustrated in FIGS. 12 and 13;

DETAILED DESCRIPTION

Figure 1:
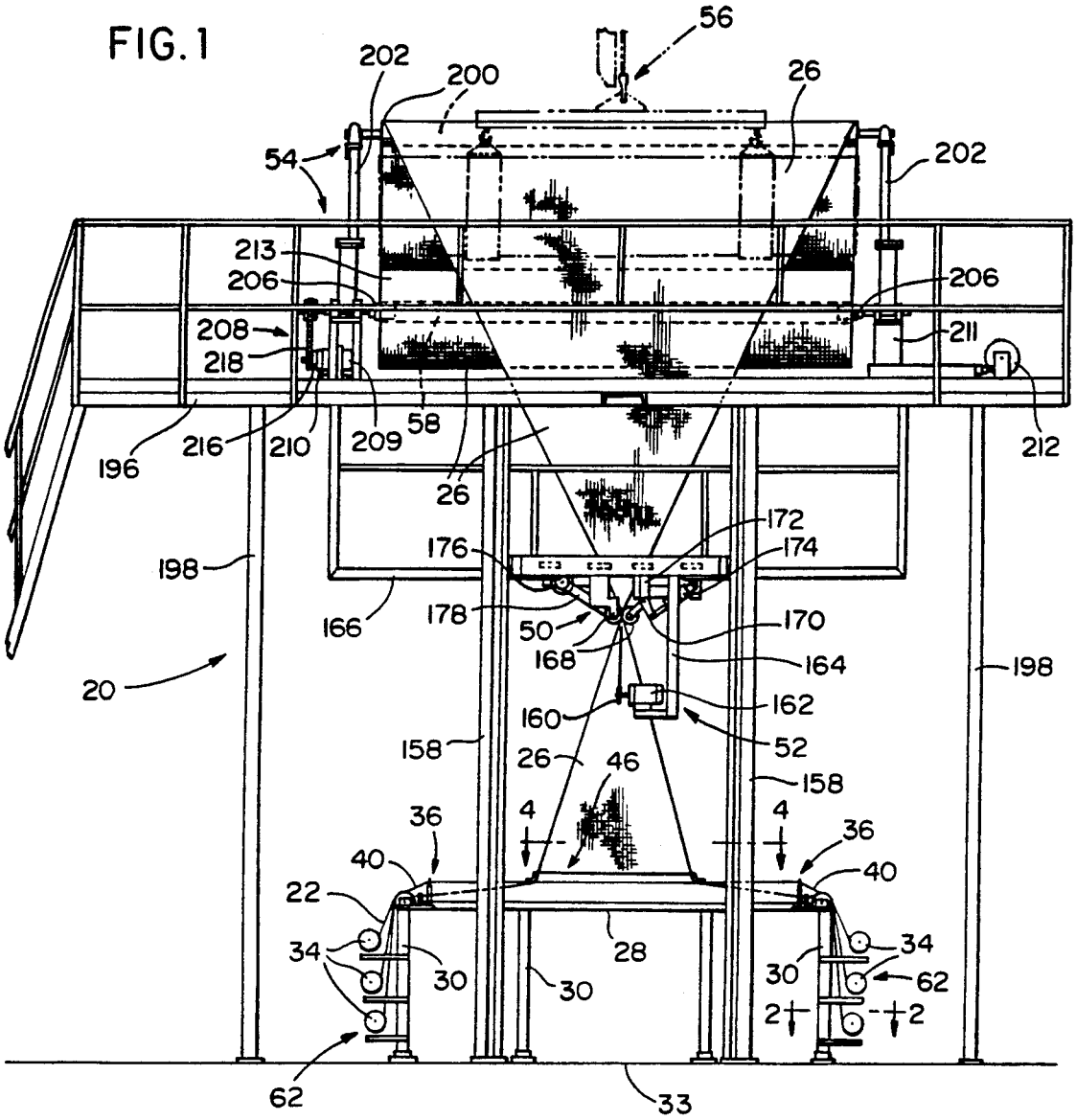
FIG. 1 is a front elevational view of a circular loom in accordance with the invention, with certain parts not shown, for clarity.
Figure 6:
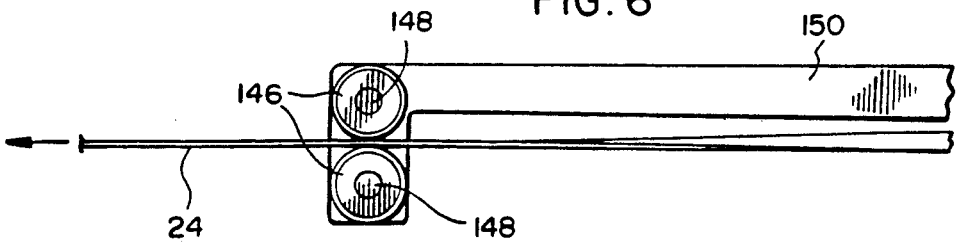
FIG. 6 is a side view of a weft ribbon-orienting mechanism of the shuttle assembly shown in FIG. 4, as viewed in the direction of the arrows 6—6 in FIG. 4.
Figure 12:
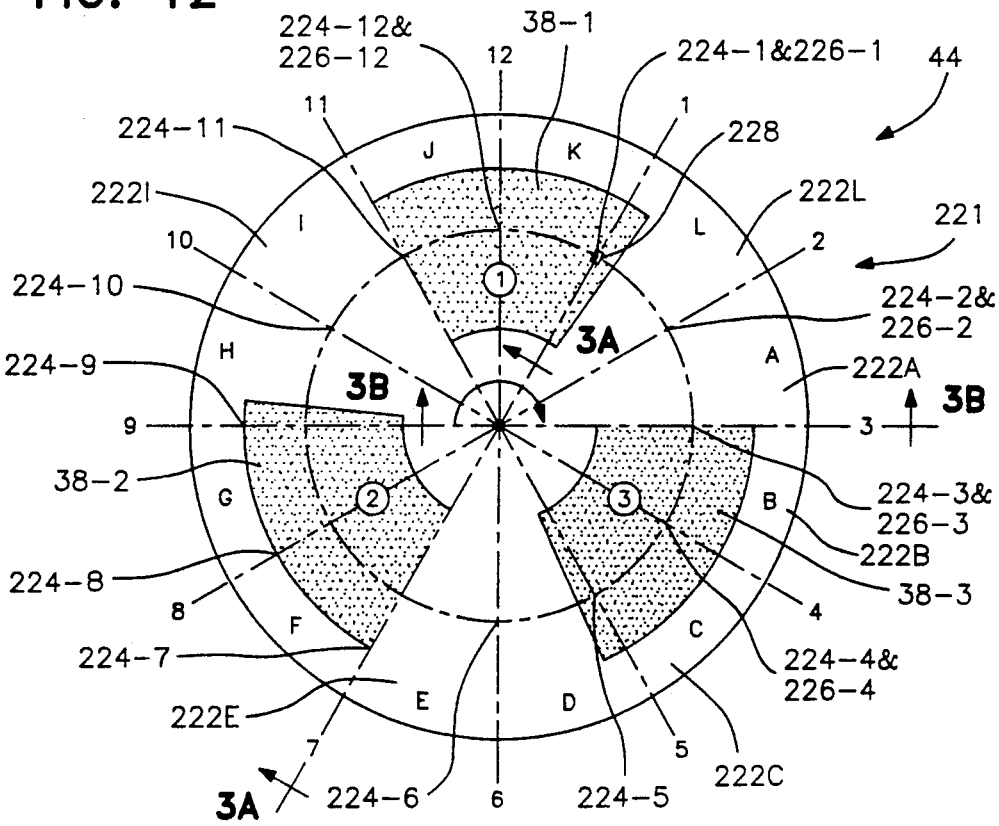
FIG. 12 is a schematic plan view of the circular loom, which supplements FIG. 11, and which illustrates a control system for presetting warp ribbons in preselected arc segments of the loom in advance of the three shuttle assemblies.
Figure 13:
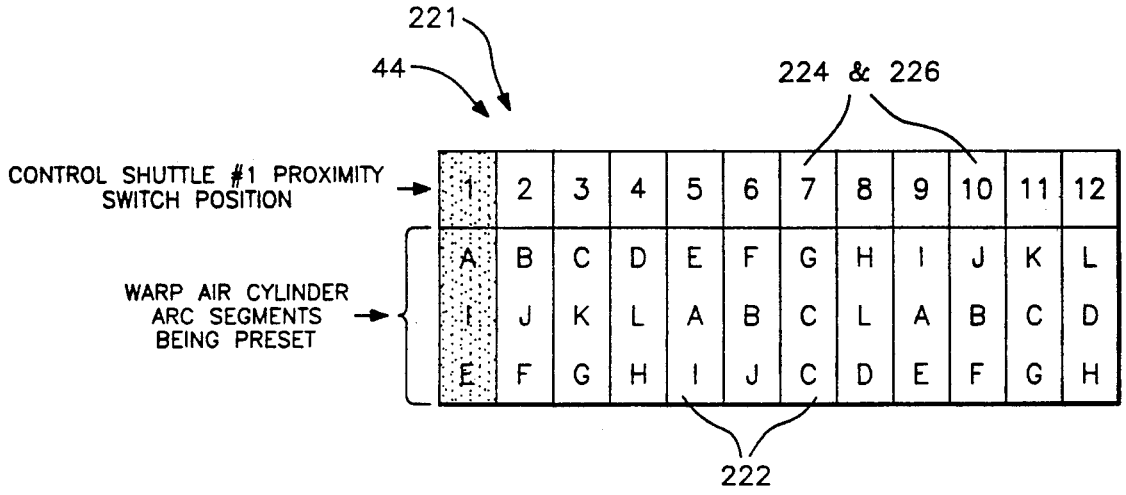
FIG. 13 is a tabular listing illustrating the arc segments of FIG. 12 in which warp ribbon air cylinders are preset as a "control" one of the shuttle assemblies passes preselected positions around the circular loom.

In general, referring to FIG. 1, a circular loom 20 which is particularly adapted for weaving warp ribbons 22 and weft ribbons 24 (FIGS. 4 and 8) having a width of up to 3 inches or more, to form an interlaced fabric 26, comprises a horizontally disposed support table 28, preferably of an annular configuration with a central opening 28*o* (e.g., see also FIGS. 3A and 3B), suitably supported on upper ends of vertically extending support posts 30 having lower ends secured to a base or floor 33. A plurality of warp ribbon supply reels 34 are mounted around the periphery of the support table 28, and the warp ribbon ends 22 travel upward from the warp ribbon supplies to a warp shed-forming mechanism 36 (best shown at the right-hand side of FIG. 3B) also arranged around the periphery of the support table. The warp shed-forming mechanism 36 orients the warp ribbon ends 22 above and below a circular path of travel of a plurality of shuttle assemblies 38 (one shown in FIGS. 4-6), each hereinafter referred to as the "shuttle", to form a series of warp sheds 40 corresponding to a preselected one of a plurality of selectable weave patterns 42, for example, as shown by the weave patterns 42-1 and 42-2 in FIGS. 11 and 15, respectively, under the control of a warp shed-presetting system 44, as illustrated in FIGS. 12, 13 and 14.

Figure 16:
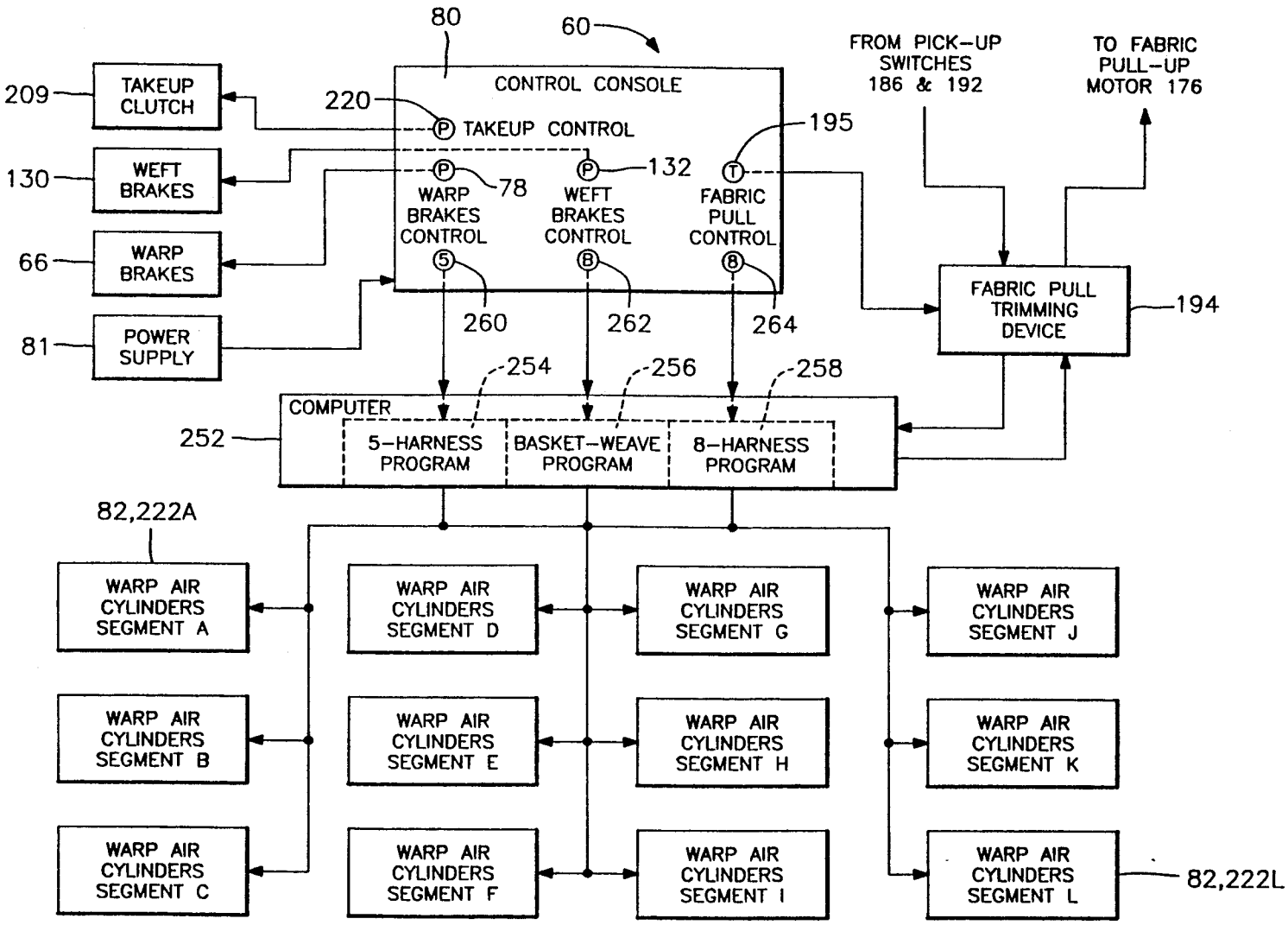
FIG. 16 is a schematic block diagram of a programmed computer control system for the circular loom.
Figure 17:
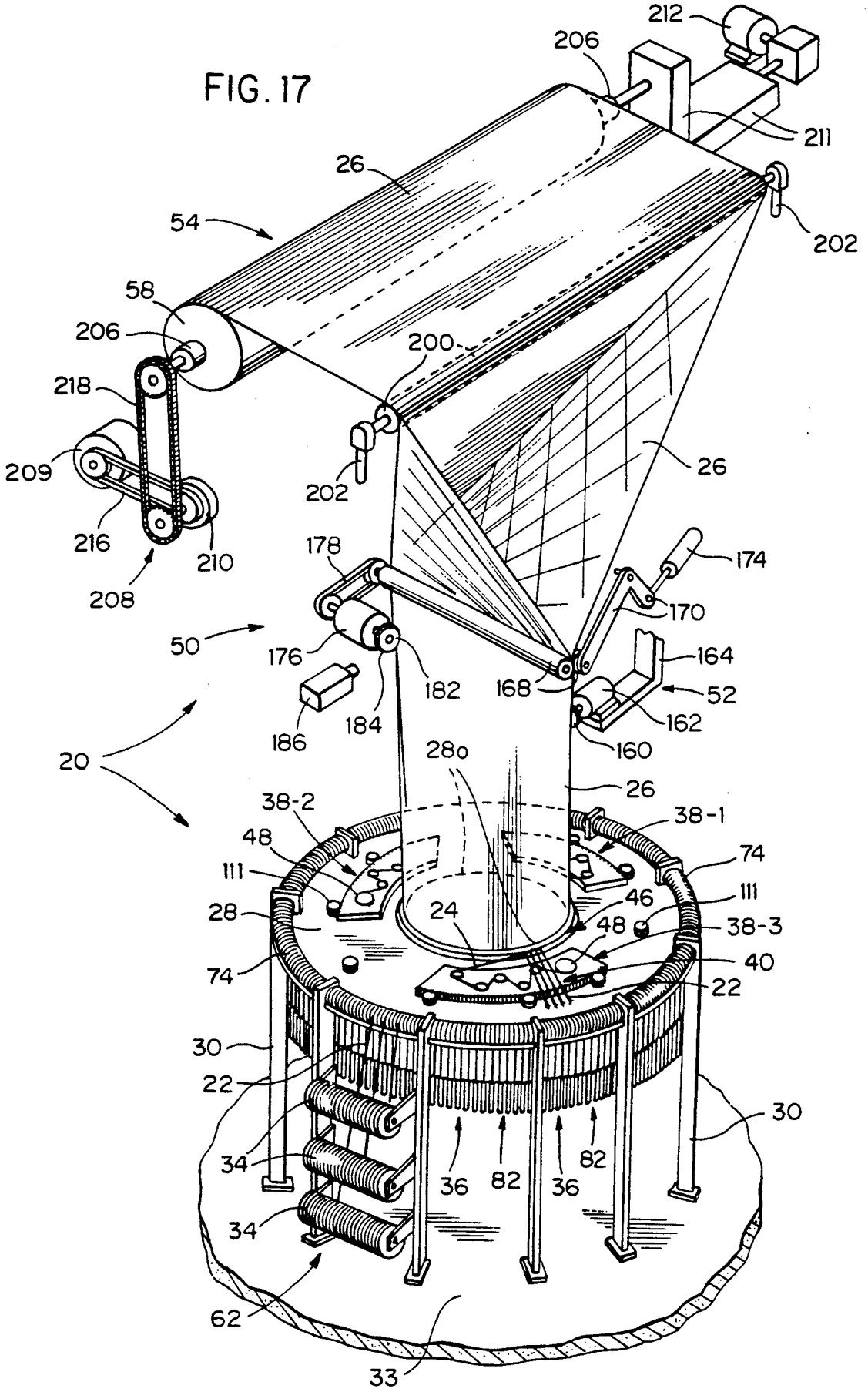
FIG. 17 is a schematic perspective view of the circular loom shown in FIGS. 1-10, with certain parts omitted.

The oriented warp ribbon ends 22 travel essentially horizontally to a fabric-forming position 46 (best shown in FIG. 8) at the center of the circular loom 20, with the fabric 26 being formed by one or more of the weft ribbon ends 24 being laid between the warp sheds 40 defined by the oriented warp ribbon ends 22 from weft supply reels 48 (one shown in FIG. 4) on respective ones of the shuttles 38 as the shuttles travel in the circular path about the support table 28. From the fabric-forming position 46, the thus formed tubular fabric 26 is pulled upwardly by a fabric-pulling mechanism 50 (FIGS. 1, 9 and 17) and is slit longitudinally by a fabric-cutting mechanism 52 (FIGS. 1, 9 and 17) prior to the fabric traveling through the fabric-pulling mechanism, and then to a take-up mechanism 54 (FIGS. 1, 10 and 17). Above the fabric take-up mechanism 54 is a reel-lifting or hoist mechanism 56 of a known type, shown in phantom lines, in FIG. 1 for placing empty take-up reels 58 in the take-up mechanism and removing full take-up reels therefrom. The circular loom 20 also includes a programmed control system 60 (FIG. 16) by which the preselected pattern of warp sheds 40 formed by the warp shed-forming mechanism 36 readily can be changed to a different pattern of warp sheds corresponding to another of the selectable weave patterns 42.

WARP RIBBON SUPPLY

Figure 2:
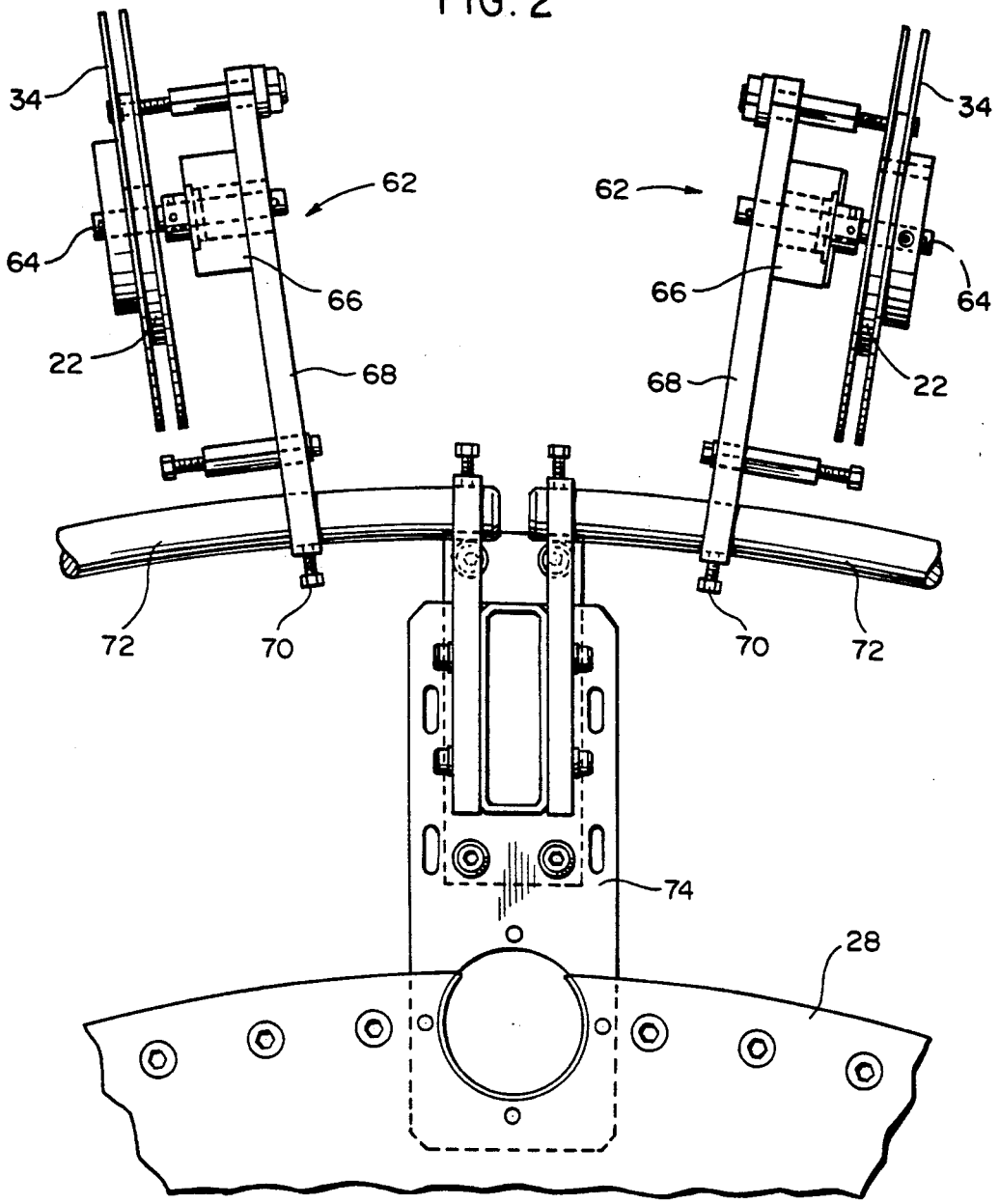
FIG. 2 is a partial plan view of a warp ribbon supply reel assembly, as viewed in the direction of the arrows 2—2 in FIG. 1.

The warp ribbon supply reels 34 are rotatably supported in stands or creels 62 located about the periphery of the support table 28 at multiple vertical levels, with only the reels at opposite sides of the support table being shown in FIG. 1. Referring to FIG. 2, each of the warp supply reels 34 is releasably mounted upon an outermost end of a rotatable shaft 64 of an electrical brake 66 for rotation with the shaft. The electrical brake 66, which may be an electrical brake available from Warner Electric, South Beloit, Ill., as their Model PB170, is fixedly mounted adjacent an outer end of a horizontally extending arm 68 having an inner end adjustably mounted, by means of a set screw 70, for circumferential positioning along one of a plurality of annular support bar segments 72. Opposed ends of the annular support bar segments 72 (only one set of ends shown in FIG. 2) are removably mounted on an outer end of a bracket assembly 74 secured at an inner end to one of the vertical support posts 30 for the support table 28.

Figure 3A:
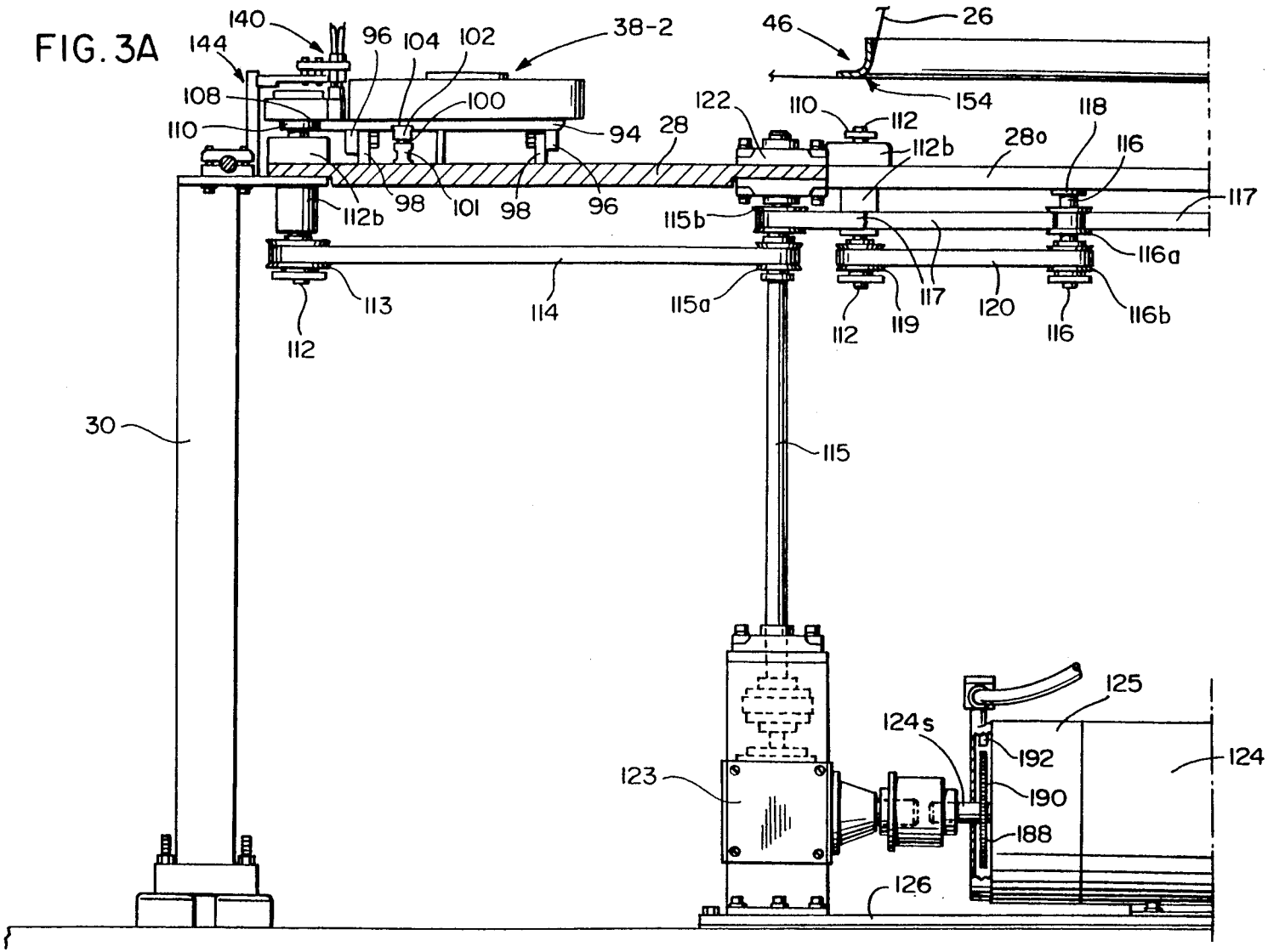
FIGS. 3A and 3B are enlarged elevational, schematic and cross-sectional views of respective halves of the circular loom shown in FIG. 1, with certain parts omitted, of portions taken 120° apart along intersecting lines designated 3A—3A and 3B—3B in FIG. 12.
Figure 3B:
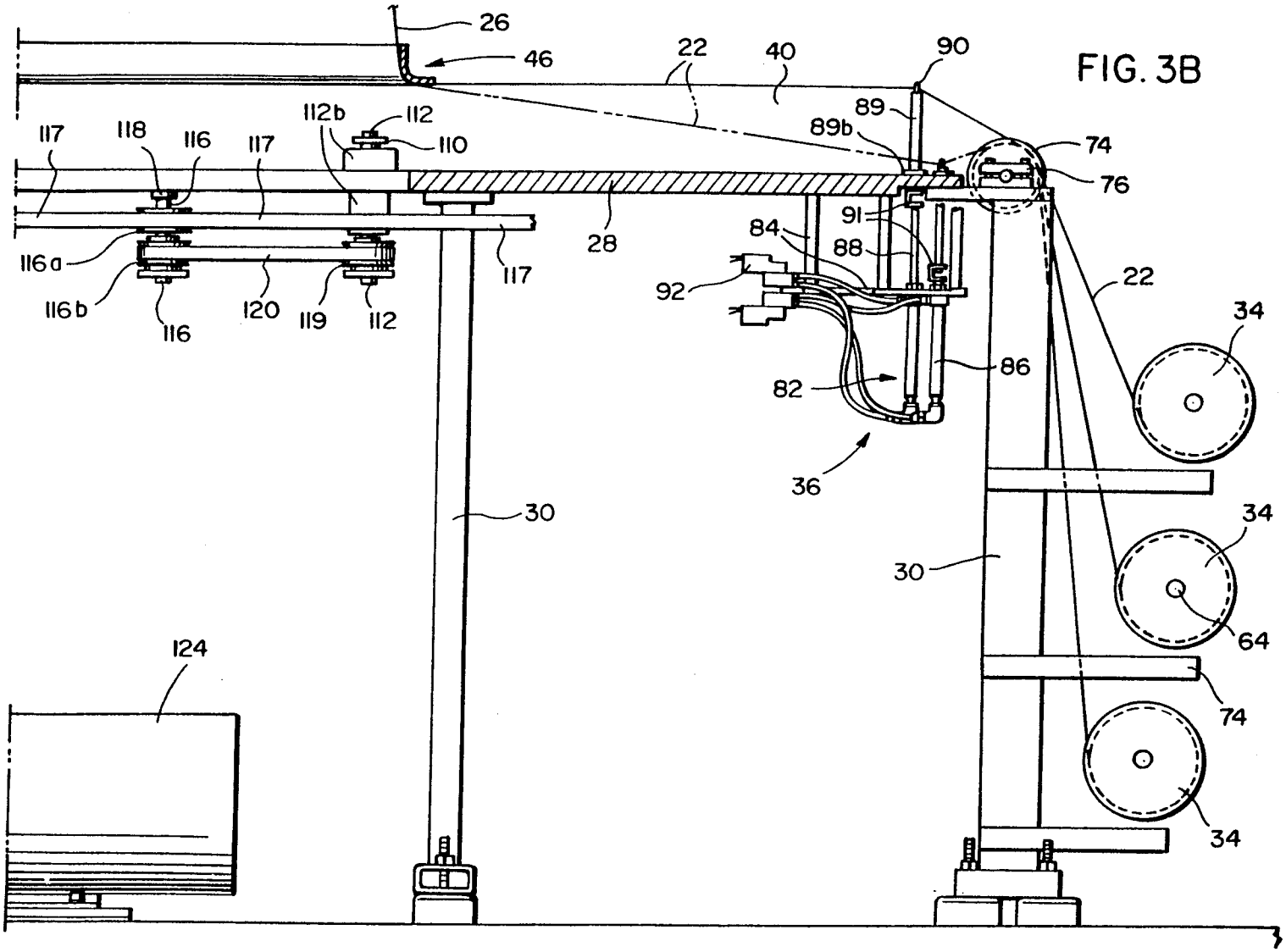

As is best shown in FIG. 3B, the warp ribbon ends 22 feed upward from the reels 34 to respective guide pulleys 74 having inner bearings, rotating on respective fixed shafts secured in supports 76 mounted about the periphery of the support table 28. During this feeding of the warp ribbons 22, a preselected voltage, set by a potentiometer 78 on an operator's control console 80 (FIG. 16) which is connected to a power supply 81, is applied to the electrical brakes 66 (FIG. 2) to maintain a preselected back tension in the warp ribbons as they travel to the warp shed-forming mechanism 36 and subsequently to the fabric-forming position 46.

WARP SHED-FORMING MECHANISM

With further reference to FIG. 3B, the warp shed-forming mechanism 36 comprises a series of fluid cylinders 82, such as air cylinders, fixedly mounted around the periphery of the support table 28 by a suitable framework 84 secured beneath the table. Each air cylinder 82 includes a cylinder portion 86 secured to the framework 84 and having a piston rod 88 extending vertically upward and provided with a rod extension member 89 having a ribbon guide member 90 at an upper end. The rod extension members 89 are mounted for vertical sliding movement in suitable bushings 89*b* and are connected to their respective piston rods 88 by coupling devices 91 which isolate the warp ribbons 22 from the piston rods so that snagging or other improper feeding of the warp ribbons from the supply reels 34 will not cause bending and/or other damage to the piston rods. For example, each coupling device 91 may be of C-shaped construction having a lower horizontal leg into which an upper end of the associated piston rod is screw-threaded, and also having an upper horizontal leg having an elongated horizontal slot for removably receiving a slotted lower portion of the associated rod extension member 89 with a sliding fit, to facilitate the connecting of the piston rod and the rod extension member together. Each guide member 90 preferably is in the form of an essentially closed loop having a horizontally elongated configuration sufficient to accommodate the width of one of the warp ribbons 22 without transverse bending thereof. Each air cylinder 82 is actuated to an extended position upon the operation of an associated solenoid 92, and is internally spring-loaded to return to a retracted position when the solenoid is de-energized.

In operation, the air cylinders 82 are operated by the programmed control system 60 (FIG. 16) to extend and retract, to form a series of the warp sheds 40 corresponding to a preselected one of a plurality of the selectable weave patterns 42, as the shuttle assemblies 38 travel about the support table 28. In this regard, the positions of the air cylinders 82 on the support table 28 and the distance to which the piston rods 88 can be extended, is such that the warp sheds 40 which are created are of sufficient vertical height that the shuttle assemblies 38 can travel through the warp sheds without engaging the warp ribbons 22 and causing distortion, undue stretching, damage and/or breakage thereof.

SHUTTLE ASSEMBLIES

Figure 4:
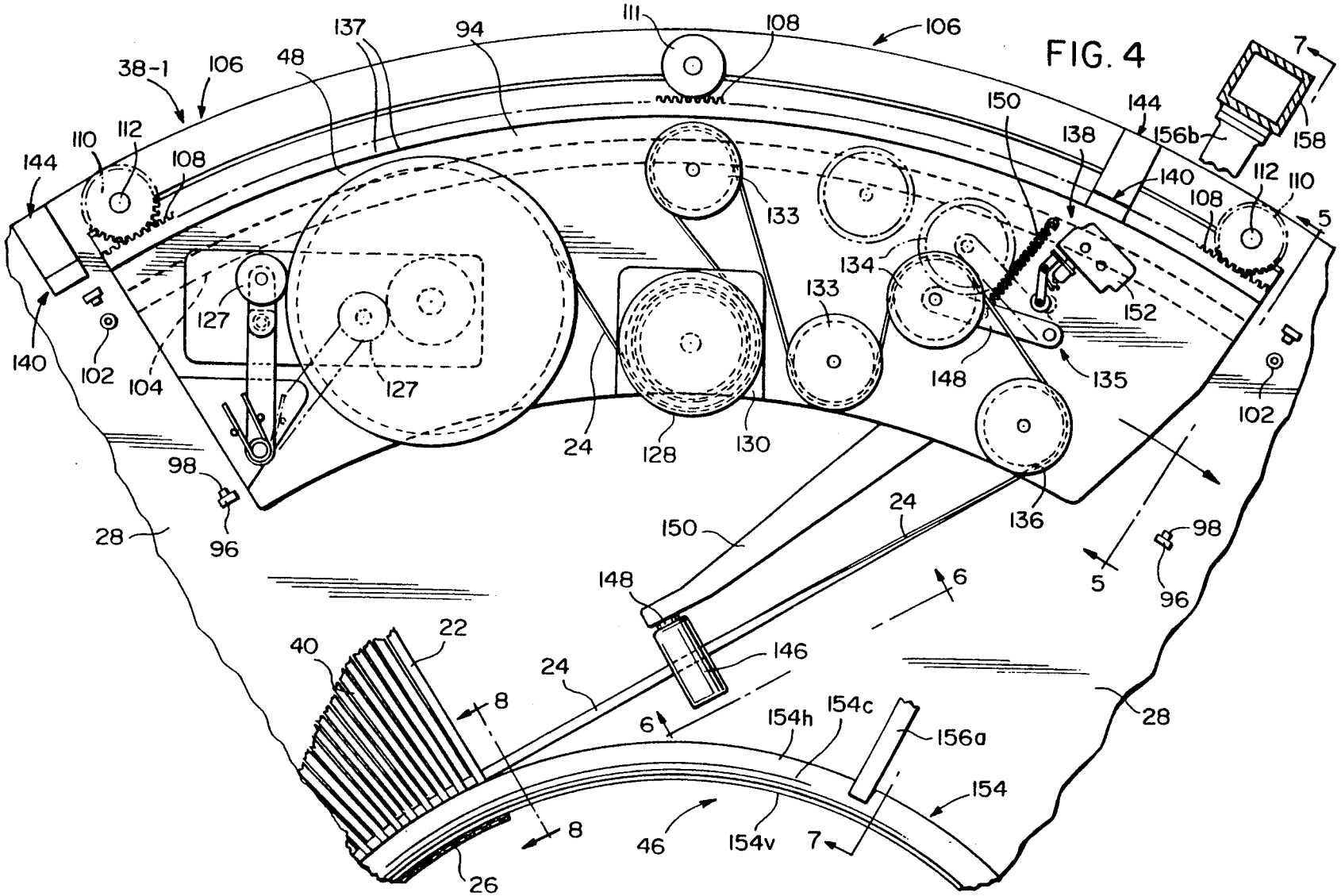
FIG. 4 is an enlarged plan view of a shuttle assembly of the circular loom shown in FIG. 1, as viewed in the direction of the arrows 4—4 in FIG. 1, with certain parts omitted.

Referring to FIGS. 4 and 12, the shuttles 38 preferably are three in number, on 120° centers, as illustrated in FIG. 12, and are of essentially identical construction. Accordingly, only a first one of the shuttles designated 38-1 in FIG. 4, is disclosed and described in detail.

With further reference to FIG. 4, the shuttle 38-1 is of precision construction to produce uniformity in the formed fabric 26, and comprises a horizontally disposed body member 94 in the form of an annular-shaped plate segment mounted for rotation around the support table 28 along a circular path and retained on the support table by its own weight and the weight of other associated parts of the shuttle. For this purpose, as is best shown in FIG. 5, the shuttle body member 94, adjacent both inner and outer edges thereof, rides on a row of circumferentially spaced and horizontally disposed (i.e., rotatably mounted on horizontal axes) support rollers 96 rotatably mounted in upstanding brackets 98 fixedly mounted on the support table 28. Intermediate the inner and outer support rollers 96, the support table 28 also is provided with a row of circumferentially spaced upwardly projecting vertical shafts 100 having lower ends fixedly mounted in brackets 101 on the support table and having upper ends provided with vertically disposed rotatable guide rollers 102. The guide rollers 102 are received with a precision fit in an annular groove 104 which is formed in a bottom surface of the shuttle body member 94 to preclude radially inward and/or outward movement of the shuttle body member, and thus the shuttle 38-1 of which it forms a part, as the shuttle rotates around the support table 28. Thus, the annular groove 104, in combination with the horizontally disposed support rollers 96 and the vertically disposed guide rollers 102, define the abovementioned circular path of movement of the shuttle 38-1 with a relatively high degree of precision, to produce uniformity in the formed fabric 26.

A shuttle drive mechanism 106 comprises a precision sector spur gear 108 (best shown in FIGS. 4 and 5) mounted on the outer periphery of the shuttle body member 94. At any one time, the spur gear 108 is sequentially engaged by at least one or more of a plurality of precision pinion gears 110 mounted in equally spaced 60° intervals about the periphery of the support table 28. A plurality of rubber-covered pressure rollers 111 (one shown in FIG. 4) for sequentially engaging the spur gear 108, also are mounted about the periphery of the support table 28 at 60° intervals between the pinion gears 110 and cooperate therewith to prevent radially outward movement of the shuttle body member 94 due to centrifugal force.

Referring to FIGS. 3A and 5, each pinion gear 110 is fixed to an upper end of a vertically extending support shaft 112 journaled in a bearing assembly **112*b* fixedly mounted on the periphery of the support table 28. With reference to the left-hand side of FIG. 3A, one of the shafts 112 has a drive pulley 113 fixed thereto and connected by a timing belt 114 directly to a fixed pulley 115*a* on a vertically disposed main drive shaft 115 beneath the support table 28. The main drive shaft 115 further includes a second pulley 115*b* connected to a series of pulleys 116*a* (two shown in FIGS. 3A and 3B), which are circumferentially arranged around the support table central opening 28*o*, by a second timing belt 117 which encircles these pulleys in engagement with radially outward peripheral portions thereof, for driving of the pulleys simultaneously. The pulleys 116*a* are fixedly mounted on depending rotatable support shafts 116 having upper ends journaled in bearings 118 on the support table 28. The shafts 116 further include fixed pulleys 116*b* connected to drive pulleys 119 on the other vertical pinion gear shafts 112 by respective radially extending timing belts 120. An upper end of the main drive shaft 115 is journaled in a bearing 122 on the support table 28 and the lower end of the main drive shaft extends into a speed reducer 123 which is driven by a motor 124 having a drive shaft 124*s*, the motors also comprising a loom electrical stopping brake 125, with the speed reducer, motor and brake being supported upon a horizontal base plate 126**.

Referring again to FIG. 4, as the shuttle 38-1 is rotated by the drive mechanism 106 to lay the weft ribbon 24 from the supply reel 48 into the warp sheds 40 in the fabric-forming position 46, the weft ribbon pays off the supply reel under the control of a spring-biased roller 127 engaged with the periphery of the weft ribbon on the supply reel. The weft ribbon 24 then travels from the supply reel 48 with the plane of the weft ribbon vertically disposed, around a guide pulley 128 supported on a shaft of an electrical brake 130. The electrical brake 130 may be of the same type used on the warp supply reels 34, as above described, to control the tension in the weft ribbon 24 to a preselected uniform value which is consistent with the tension being maintained in the warp ribbons 22 and also may be controlled by a potentiometer 132 on the operator's control console 80, as illustrated in FIG. 16. The weft ribbon 24 then travels about a series of guide pulleys 133 rotatably mounted upon vertical shafts having lower ends fixedly mounted in the shuttle body member 94, a guide pulley 134 of a weft break-detector mechanism 135, and an exit guide pulley 136 of the same type as the guide pulleys 133, and then to the fabric-forming position 46.

Referring to FIG. 5, electrical power is provided to the electrical brake 130 of the shuttle 38-1 by a pair of annular-shaped slip-ring segments 137 mounted, by means of an electrical insulator member 138 to which they are suitably secured, on top of the shuttle body member 94 about its periphery. A plurality of pairs of electrical brush assemblies 140, including brushes 142 for engaging the slip-ring segments 137, are provided at spaced intervals about the path of travel of the shuttle so as to maintain continuous electrical contact with the slip-ring segments. Each pair of the brush assemblies 140 is mounted on the support table 28 by a suitable brush support bracket assembly 144. In addition, the slip-ring segments 137 are suitably wired to the electrical brake 130 by connector leads, not shown.

As the weft ribbon 24 travels to the fabric-forming position 46, the orientation of the weft ribbon is changed from one in which the plane of the ribbon is vertically disposed, to a position in which the plane of the ribbon is horizontally disposed, i.e., parallel to the circular path of the shuttle 38-1 on the support table 28. For this purpose, referring to FIGS. 4 and 6, a pair of opposed horizontally disposed weft ribbon-turning rollers 146 is provided between the shuttle exit guide pulley 136 and the fabric-forming position 46, so that as the weft ribbon 24 travels therebetween, the desired turning movement of the weft ribbon is accomplished under controlled conditions. The weft ribbon-turning rollers 146 are journaled on support shafts 148 having inner ends fixedly mounted to an outer end of a mounting bracket 150 having an inner end fixedly mounted upon the shuttle body member 94. Thus, the rollers 146 can control turning of the weft ribbon 24 from the vertically disposed planar configuration thereof as it leaves the exit guide pulley 140, 90° and into a horizontally disposed planar configuration, as the weft ribbon travels into the fabric-forming position 46.

With further reference to FIG. 4, the guide pulley 134 of the weft ribbon break-detector mechanism 135 is rotatably mounted on an outer end of a lever member 148 having an inner end pivotably mounted on the shuttle body member 94. The lever member 148 is biased clockwise, as viewed in FIG. 4, by a coil spring 150 secured at one end to the shuttle body member 94 and secured at its opposite end to the lever member. In normal operation, the tension in the weft ribbon 24 as it travels around the guide pulley 134 maintains the guide pulley and the lever member 148 in a solid line position in FIG. 4, with the lever member spaced from a limit switch 152 fixedly mounted on the shuttle body member 94. However, upon breakage of the weft ribbon 24, the coil spring 150 biases the guide pulley 134 and the lever member 148 to a broken line position in FIG. 4, in which as is clearly shown in this figure, the lever member engages and thus immediately operates the limit switch 152 to stop the operation of the loom 20.

FABRIC-FORMING POSITION MECHANISM

Figure 7:
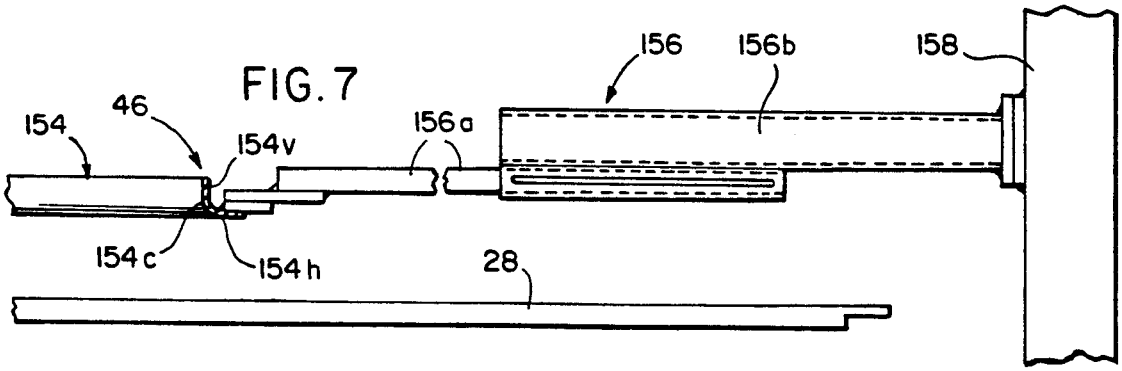
FIG. 7 is a cross-sectional view, illustrating a fabric-forming ring support assembly, taken along the line 7—7 in FIG. 4.

As is best shown in FIGS. 7 and 8, the fabric-forming position 46 includes a mechanism comprising an annular ring member 154 which is of right-angle construction as viewed in cross-section, with a first leg **154*v* extending vertically parallel to a tubular fabric-forming plane, and a second leg 154***h* extending horizontally and radially outward perpendicularly to the fabric-forming plane, with the first and second legs being interconnected by an intermediate curved section 154*c*. The annular ring 154 is supported by a plurality of radially extending, adjustable support arm assemblies 156 (FIG. 7) having telescoping inner and outer arms 156*a* and 156*b*, respectively. An inner end of each inner arm 156*a* is welded to a top surface of the ring horizontal leg 154*h*, and an outer end of each outer arm 156*b* is welded to an intermediate portion of an associated one of a plurality of vertically extending support posts 158 for the fabric-pulling mechanism 50 and the take-up mechanism 54.

Figure 11:
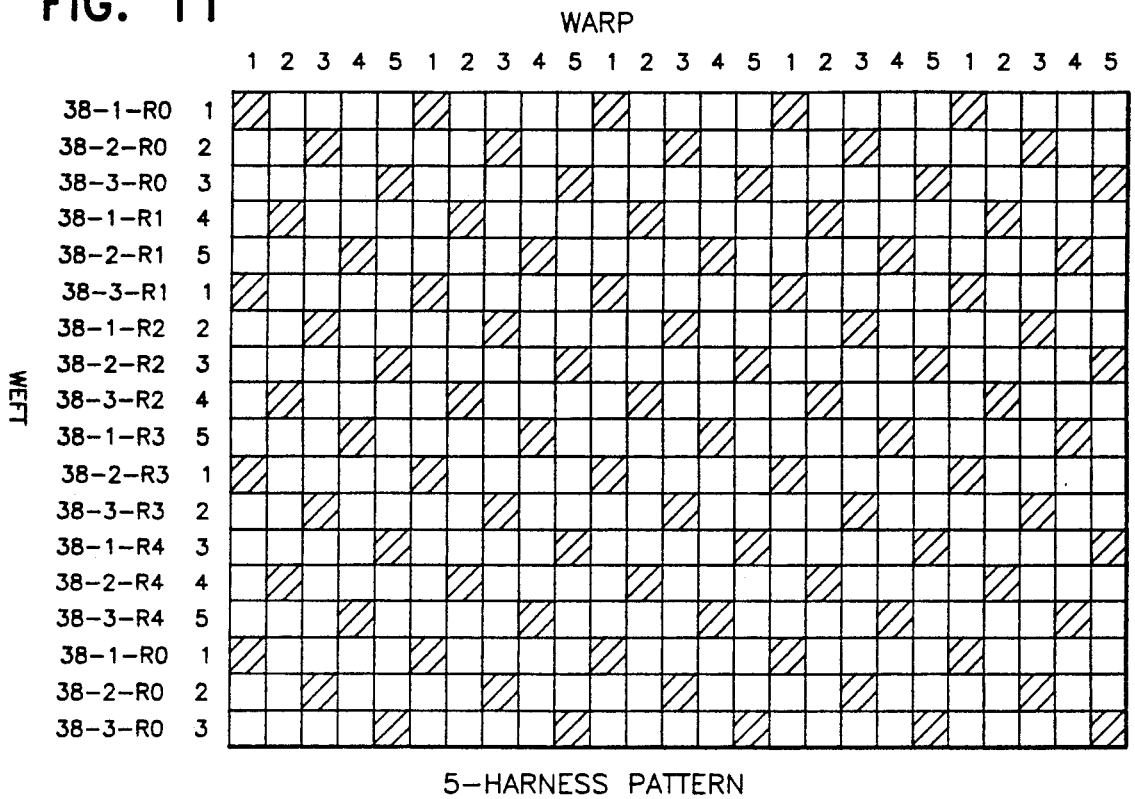
FIG. 11 is a schematic plan view of a conventional 5-harness interlaced weave pattern, illustrating the interlacing of warp and weft ribbons using three shuttle assemblies.
Figure 15:
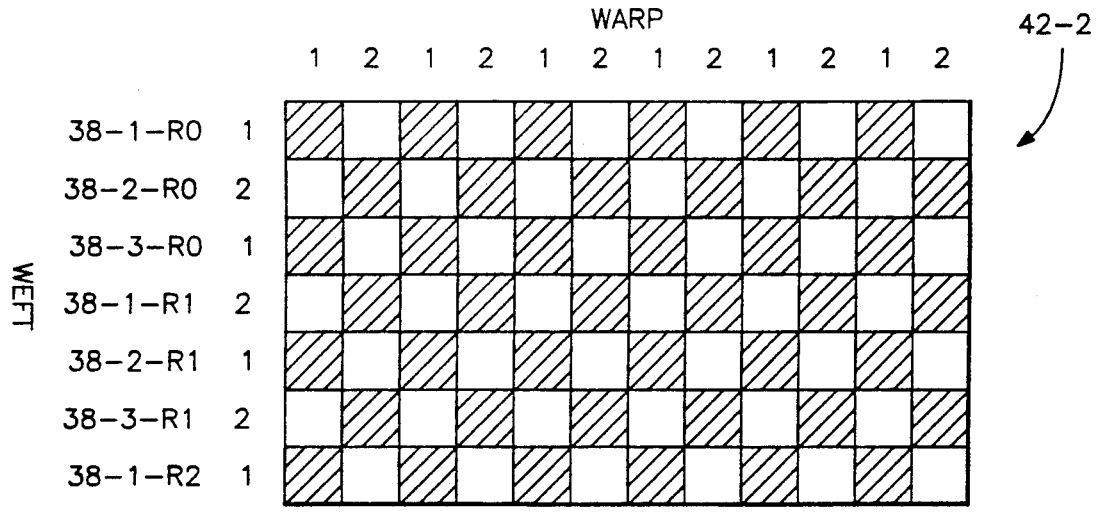
FIG. 15 is a schematic plan view of a conventional basket-weave interlaced pattern.

In order to best illustrate the manner in which the tubular fabric 26 is formed in the fabric-forming position 46, the basket-weave pattern 42-2 as shown in FIG. 15 has been used, but it is to be understood that the fabric-forming principles involved are generally applicable to any other type of weave pattern, such as the 5-harness interlaced pattern 42-1 shown in FIG. 11, or that known in the art as an 8-harness interlaced pattern (not shown). Thus, in operation, the warp ribbons 22 travel from the warp guide members 90 in the warp shed forming mechanism 36, to a radially outward edge of the horizontally disposed leg 154*h* of the fabric-forming ring 154, travel along the underside of this leg parallel to the circular path traveled by the shuttle assembly 38-1, around the curved ring section 154*c*, and into engagement with an inner surface of the vertically extending leg 154*v* of the fabric-forming ring. At the same time, the weft ribbon 24, which is in an essentially horizontally disposed planar position as it approaches the fabric-forming position 46, becomes laid between upper and lower ones of the warp ribbons 22 so that when the warp ribbons close together as they engage and travel along the underside of the horizontally disposed leg 154*h* of the fabric-forming ring 154, the weft ribbon 24 becomes disposed or "trapped" between the upper and lower warp ribbons, with the warp ribbons and the weft ribbon interlaced in an essentially common plane. The weft ribbon 24 then travels with a transverse sliding movement along with the warp ribbons 22 about the curved ring section 154*c* and the inner surface of the fabric-forming ring vertical leg 154*v*, with a slight upwardly spiraling movement, and essentially without any twist about a transverse axis of the weft, as the tubular fabric is advanced vertically upward by the fabric-pulling mechanism 50. As a result, the weft ribbon 24 crosses the warp ribbons 22 at a slight angle, rather than exactly perpendicular thereto, so that the weft and warp ribbons cause the formed tubular fabric 26 to be of a more uniform flatter construction as compared to fabrics which are formed on prior known reciprocating-type looms.

FABRIC-CUTTING MECHANISM

As is shown in FIGS. 1 and 10, the fabric-cutting mechanism 52 is mounted between the fabric-forming ring 154 and the fabric-pulling mechanism 50 and includes a rotary knife 160. The rotary knife 160 is supported on an outer end of a drive shaft of a motor 162 mounted on a framework 164 suspended beneath a first lower platform 166 which is supported at its opposite corners on intermediate portions of the vertical posts 158. Thus, as the formed tubular fabric 26 is moved upward by the fabric-pulling mechanism 50, the rotary knife 160 cuts the tubular fabric longitudinally along a line on one side thereof, after which the fabric continues its upward movement to the fabric-pulling mechanism and enters the fabric-pulling mechanism in a folded-over condition, with the fold in the fabric extending essentially along a line on an opposite side thereof from the cut-line of the rotary knife, as is illustrated in FIGS. 1, 9 and 10.

FABRIC-PULLING MECHANISM

Referring further to FIGS. 1 and 9, the fabric-pulling mechanism 50, which is supported on the lower platform 166 above the level of the fabric cutting mechanism 52, comprises a pair of opposed pressure rollers 168. As is best shown in FIG. 1, one of the pressure rollers 168 has opposite ends journaled for rotation on the platform 166. The second pressure roller 168 is supported at its opposite ends for rotation at one end of a bell crank linkage 170 pivotably mounted in a bracket assembly 172 depending from the platform 166. The latter pressure roller 168 is movable toward and away from the first pressure roller, by a fluid (e.g., air) cylinder 174 mounted beneath the platform 166, and the length of the pressure rollers is such that they apply a preselected gripping pressure upon opposed central portions of the formed fabric 26 spaced from the cut-and-fold lines without crushing or otherwise damaging the fabric. The first pressure roller 168 is driven by a motor 176 mounted on the platform 166, through a timing belt or chain 178, to cause upward pulling movement of the fabric 26 from the fabric-forming ring 154.

As is best shown in FIG. 9, the drive speed of the fabric pull-up motor 176 is controlled so as to be in synchronism with the speed of the drive motor 124 for the shuttles 38, depending upon the width of the weft ribbon 24 being processed, so that the weft ribbon becomes laid into the warp ribbon sheds 40 with edges of the weft ribbon in abutting relationship, and so that the fabric 26 is formed without gaps and/or weft ribbon overlaps, to produce a tight uniform weave. For this purpose, a drive shaft 180 of the motor 176 is provided with a fixed gear 182 having a large number (e.g., 60) of teeth 184 on its periphery. A magnetic pick-up switch 186 is mounted on the platform 166 (FIG. 1) opposite and at a precise radial distance from the gear 182, to count pulses as represented by the gear teeth 184. An identical system is provided for the shuttles 38 and includes an identical gear 188 with teeth 190, mounted on a portion of the drive shaft 124*s* of the shuttle drive motor 124, with a magnetic pick-up switch 192 being mounted opposite and at the same precise radial distance from that gear.

The pick-up switches 186 and 192 are electrically connected to a comparator circuit in a computer or microprocessor controlled feedback-type "trimming" device 194 (FIGS. 2 and 16), which may be of a known type such as that available from Fenner Control of Minneapolis, Minn., under the trademark "M TRIM". The "trimming" device 194 compares the pulses received from the pick-up switches 186 and 192 and makes any necessary adjustment in the speed of the drive motor 176 for the fabric-pulling mechanism 50, to maintain the motor at a desired relative speed to the speed of the shuttle drive motor 124, so that the fabric-pulling mechanism constantly advances the fabric 26 vertically upward at a rate such that the weft ribbon 24 is laid into the fabric to form a tight uniform weave as above described.

By way of illustration, if the weft ribbon 24 has a width of 0.50 inches and three shuttles 38 and weft ribbon supplies 48 are used, the fabric 26 will be advanced vertically upward by the fabric-pulling mechanism 50 at a constant rate of 1.5 inches for each revolution of the shuttles. This may be accomplished by setting a dial 195 (FIG. 16) on the operator's control console 80 to a preselected value representative of the speed ratio between the shuttle and fabric-pulling motors 124 and 176, respectively, to achieve this rate of advancement to an accuracy of 0.01%. Similarly, if the weft ribbon 24 has a slightly smaller width, such as 0.49 or 0.51 inches, the speed ratio setting can be increased or decreased, respectively, and still attain the desired tight uniform weave. Further, if during the fabric-forming operation it is noted that the fabric 26 is being formed with slight weft ribbon gaps or overlaps, the motor speed ratio may be "trimmed" accordingly. In the alternative, the "trimming" device 194 also can be set to provide an accurate gap between adjacent weft ribbon portions where this is desired.

TAKE-UP MECHANISM

With further reference to FIGS. 1 and 10, the take-up mechanism 54 is mounted on an upper platform 196 (FIG. 1) which is located above the fabric-pulling mechanism 50, with the upper platform being centrally supported on upper ends of the vertical posts 158 and being supported on additional vertical posts 198 adjacent its opposite ends. The take-up mechanism 54 includes a horizontally disposed guide roller 200 having a length capable of supporting the formed fabric 26 in an opened condition. Thus, after the cut-and-folded fabric 26 leaves the fabric-pulling mechanism 50, the fabric opens and fans out as it travels to and over the guide roller 200, which is journaled at its opposite ends for free rotation in upper ends of vertical post assemblies 202 (FIG. 1) having lower ends secured to the upper platform 196. The opened-and-fanned fabric 26 then travels in a slightly downward path to the take-up reel 58, which is removably mounted for rotation in opposed take-up spindles 206 supported on the upper platform 196 below the level of the guide roller 200. The left-hand one of the spindles 206, as viewed in FIG. 1, is rotated by a drive system 208 including a motor 209 and an electromagnetic clutch 210 on the upper platform 96. The other spindle 206 is horizontally movable between reel-engaging and reel-disengaging positions by a screw-operated slide 211 (FIG. 1) driven by a motor 212 in a known manner.

In order to control the tension on the fabric 26, and to isolate the tension between the guide roller 200 and a product roll 213 on the take-up reel 58, as is illustrated in FIG. 10, the electromagnetic clutch 210 is installed between the take-up drive motor 209 and the driven take-up spindle 206, with the drive motor being connected to the electromagnetic clutch by a timing belt 216, and the clutch being connected to the take-up spindle by a roller chain 218. In operation, a potentiometer 220 (FIG. 16) on the operator's control console 80 is adjusted to control the voltage applied to the electromagnetic clutch 210 so that, with the drive motor 209 constantly driving the input side of the clutch, as fabric loops develop between the guide roller 200 and the take-up reel 58, as illustrated by the broken line in FIG. 10, the spindle 206 connected to the output side of the clutch is driven by the clutch to take up the fabric 26 on the reel in a relaxed state without the fabric being subjected to excessive tension.

WARP SHED PRESETTING SYSTEM

Referring to FIGS. 11, 12, 13 and 14, by way of example, a system 221 is shown for presetting the warp ribbon air cylinders 82 using three of the shuttles 38-1, 38-2 and 38-3, as illustrated in FIG. 12, to form the fabric 26 with the weave pattern 42-1 known in the art as a "5-harness interlaced" weave pattern, as illustrated in FIG. 11. In this regard, in the 5-harness interlaced weave pattern 42-1 of FIG. 11, each weft ribbon 24 and each warp ribbon 22 passes over one ribbon extending perpendicularly thereto, then under four of the ribbons extending perpendicular thereto, and then under one more of the ribbons extending perpendicular thereto, and so forth, to form the 5-harness interlaced pattern. (In FIG. 11, "under" weft ribbon portions are shaded and "over" weft ribbon portions are unshaded; on the opposite side of the material, the pattern is reversed.) Thus, the pattern 42-1 repeats itself in both the warp and weft directions every five ribbons as is indicated by the numbering along the top and the left-hand side of FIG. 11.

More specifically, with reference to FIG. 11, a first weft ribbon 24 designated "1" at the left-hand side of this figure, passes under every fifth warp ribbon 22, designated "1" at the top of this figure, while passing over the four intervening warp ribbons designated "2", "3", "4" and "5", in this figure. Similarly, a second weft ribbon 24 designated "2" passes under each of the warp ribbons 22 designated "3" at the top of the figure, while passing over each of the intervening warp ribbons designated "4", "5", "1" and "2". In like manner, a third weft ribbon 24 designated "3", passes under each of the warp ribbons 22 designated "5" at the top of the figure, while passing over the four intervening warp ribbons designated "1", "2", "3", and "4". A fourth weft ribbon 24, designated "4", passes under each of the warp ribbons 22 designated "2" at the top of the figure, while passing over each of the intervening warp ribbons designated "3", "4", "5" and "1". Finally, a fifth weft ribbon 24, designated "5", passes under each of the warp ribbons 22 designated "4" at the top of the figure, and over the intervening four warp ribbons designated "5", "1", "2" and "3", whereupon the pattern repeats itself.

Referring to FIG. 12, for the purpose of controlling the warp ribbon-setting air cylinders 82 (FIG. 3B) in preparation for each pass of the three shuttles 38, the circular loom 20 in accordance with the invention is divided into twelve arc segments 222 as indicated by the letters "A-L" in this figure, which are defined by twelve position points 224 identified by the numbers "1-12" around the periphery of the figure, with each segment encompassing an arc of 30°, and with the last arc segment 222L being defined by the position points 224-1 and 224-2. Referring also to FIG. 5, each of the twelve segment position points 224 includes an associated proximity switch 226 suitably mounted on the support table 28 beneath the path of travel of the rotating shuttle body members 94. Each of the proximity switches 226 may be of any suitable type, such as one which is activated only when within a preselected distance (e.g., 0.06") of another member, such as the Honeywell Corporation proximity switch Model No. 922AA3W-A9P-L.

Thus, in accordance with this invention, to activate the proximity switches 226, a target member 228, in the form of a small rectangular metal plate, is mounted under the leading edge of the body member 94 (FIG. 4) of the first shuttle 38-1, which also acts as a "control" for the other shuttles 38-2 and 38-3. More specifically, when the target member 228 on the first shuttle assembly 38-1 reaches the position point 224-1 defining the beginning of the arc segment 222L, the proximity switch 226-1 in that position is operated to cause operation of the appropriate air cylinders 82 in advance of each of the three shuttles 38, in preparation for subsequent passage of the shuttles therethrough and thus, in order to increase the speed at which the loom 20 can operate.

In this regard, and with further reference to FIG. 12, the arc segment 222A is defined by the segment position points 224-2 and 224-3, the arc segment 222B is defined by the segment position points 224-3 and 224-4, and so forth, with the last arc segment 222L being defined by the segment position points 224-1 and 224-2, as noted previously. Thus, with reference to FIG. 13, when the target member 228 on the first shuttle 38-1 is at position point 224-1, the proximity switch 226-1 at that position becomes operated and causes energization of the fixedly mounted warp ribbon-setting air cylinders 82 in the arc segment 222A, which is then between the first shuttle and the third shuttle 38-3, for the subsequent passage of the first shuttle. At the same time, the proximity switch 226-1 causes operation of the warp ribbon-setting air cylinders 82 in the arc segment 222I (defined by the segment position points 224-10 and 224-11), which is then between the first and second shuttles 38-1 and 38-2, respectively, for subsequent passage of the second shuttle, the leading edge of which then is located at segment position point 224-9. Similarly, the proximity switch 226-1 also simultaneously causes operation of the warp ribbon-setting air cylinders 82 in arc segment 222E (defined by segment position points 224-6 and 224-7), which is then between the second and third shuttles 38-2 and 38-3, respectively, for subsequent passage of the third shuttle, the leading edge of which then is located at segment position point 224-5.

Similarly, when the target member 228 on the first shuttle 38-1 reaches segment position point 224-2, the proximity switch 226-2 at that position point will cause operation of the air cylinders 82 in arc segments 222B, J and F for the first, second and third shuttles 38-1, 38-2 and 38-3, respectively, as is also indicated in FIG. 13. This presetting of the warp ribbon-setting air cylinders 82 then is continued in a similar fashion as the target member 228 on the first shuttle 38-1 reaches each of the subsequent segment position points 224-3 through 224-12, as indicated in FIG. 13, whereupon the air cylinder-presetting operation is repeated for the next revolution of the shuttles 38.

In this connection, referring again to the left-hand side of FIG. 11, the first, second and third shuttles 38-1, 38-2 and 38-3 have been designated as such in this figure. Further, five successive revolutions of the shuttle 38-1, 38-2 and 38-3 have been designated "R0" for the initial revolution, with the next four revolutions being designated "R1", "R2", "R3" and "R4", respectively.

Thus, referring to the flow chart of FIG. 14 in conjunction with the fabric pattern 42-1 of FIG. 11, upon the initial revolution of the shuttle 38-1, when the target member 228 on the first shuttle 38-1 reaches the segment position point 224-1 in FIG. 12, the proximity switch 226-1 will cause presetting of the air cylinders 82 for the warp ribbons 22 designated "1" in arc segment 222A to an "up" position, and set all of the associated warp ribbons designated "2", "3", "4" and "5" in this arc segment to a "down" position (as may be necessary depending upon the positions of the air cylinders at that time), in preparation for subsequent passage of the first shuttle therethrough. At the same time, the proximity switch 226-1 presets all of the warp ribbons 22 designated "3" in arc segment 222I to an "up" position, and all of the warp ribbons in that arc segment designated "4", "5", "1" and "2" to a "down" position for subsequent passage of the second shuttle 38-2. Similarly, the proximity switch 226-1 causes operation of the air cylinders 82 for the warp ribbons 22 designated "5" in arc segment 222E to an "up" position, and the air cylinders for the warp ribbons designated "1", "2", "3" and "4" in that arc segment to a "down" position for subsequent passage of the third shuttle 38-3. The remaining proximity switches 226-2 through 226-12 at the segment position points 224-2 through 224-12 also function in the same manner when the target member 228 on the first shuttle 38-1 reaches these switches, to preset the air cylinders 82 in the arc segments 222B–L, respectively.

Similarly, when the target member 228 on the first shuttle 38-1 reaches the position point 224-1 on the next revolution "R1" of the shuttle, the proximity switch 226-1 functions as above described to again preset the air cylinders 82 in the arc segments 222A, I and E, for subsequent passage of the first, second and third shuttles 38-1, 38-2 and 38-3, respectively. In this instance, however, with reference to FIGS. 11 and 14, the proximity switch 226-1 sets the air cylinders 82 for the warp ribbons 22 designated "2" in arc segment 222A to an "up" position, and sets the remaining warp ribbons designated "3", "4", "5" and "1" into a "down" position (as may be necessary) for this revolution of the first shuttle 38-1. Similarly, the proximity switch 226-1 causes setting of the air cylinders 82 for the warp ribbons 22 designated "4" in arc segment 222I to an "up" position, with the remaining air cylinders in this segment being set to a "down" position, and also causes setting of the air cylinders for the warp ribbons designated "1" in arc segment 222E to an "up" position, with the remaining air cylinders in that segment being set to a "down" position, for subsequent passage of the second and third shuttles 38-2 and 38-3, respectively. This same system of presetting the air cylinders 82 in the arc segments 222A, I and E then is continued as the target member 228 on the first shuttle 38-1 reaches each of the subsequent arc segment position points 224-2 through 224-12.

The same system of presetting the air cylinders 82 for the warp ribbons 22 then is continued for the next three revolutions "R2", "R3" and "R4" of the three shuttles 38, as will be apparent from FIGS. 11 and 14. For example, on the next revolution of the first shuttle 38-1 designated "R2", the air cylinders 82 for the warp ribbons 22 designated "3" in arc segment 222A will be set into "up" positions, with the air cylinders for the remaining warp ribbons in that arc segment being set into "down" positions. Similarly, for the revolution of the second shuttle 38-2 designated "R2", the air cylinders 82 for the warp ribbons 22 designated "5" in arc segment 222I will be set into "up" positions, with the air cylinders for the remaining warp ribbons in that arc segment being set into "down" positions. In like manner, for the revolution of the third shuttle 38-3 designated "R2", the air cylinders 82 for the warp ribbons 22 designated "2" in arc segment 222E will be set into "up" positions, while the air cylinders for the remaining warp ribbons in that arc segment will be set into "down" positions. The warp ribbons 22 then will be preset for the shuttle revolutions designated "R3" and "R4" in a similar manner, after which the above described sequence of warp ribbon-setting will again be repeated.

With further reference to the flow chart of FIG. 14, this figure illustrates steps which may be used in the presetting of the warp ribbon-setting air cylinders 82 each time the first or "control" shuttle 38-1 reaches and energizes the first proximity switch 226-1. In this regard, all of the proximity switches 226 feed to a proximity switch counter 230 which keeps track of which of the proximity switches has been energized. The proximity switch 226 which has just been energized then is determined in a step 232, and if the proximity switch which was just energized is the first proximity switch 226-1, a signal is applied to a revolution counter 234, which keeps track of the number of revolutions which the first shuttle 38-1 has made. The revolution number "R0"-"R4" then is determined in a series of steps 236-244. Assuming that in step 236 it is determined that this is the first revolution "R0" of the first shuttle 38-1, a signal is applied to the solenoids 92 (FIG. 3B) of the air cylinders 82 in the arc segments 222A, I and E, to preset the air cylinders into their respective "up" or "down" positions, as above-described. This same procedure then is followed for each subsequent revolution "R1"-"R4" for the first shuttle 38-1 as illustrated in FIG. 14. Further, in the step 244, when it is determined that the first shuttle revolution number is "R4", a "reset" signal 246 also is fed back to the revolution counter 234.

If in step 232, it is determined that the proximity switch 226 which has just been actuated is not the first proximity switch 226-1, a step 248 is performed to determine if the just-energized proximity switch is the second proximity switch 226-2. If the answer is "yes", a signal is applied to a second revolution counter 250 which corresponds to the first revolution counter 232, and a series of steps corresponding to the steps 236-244 for the first proximity switch 226-1, are carried out to preset the warp ribbon-setting air cylinders 82 in the arc segments 222B, J and F (as indicated in FIG. 13) in the same manner. This same procedure then is followed for subsequent ones of the proximity switches 226-3 through 226-12 as they become energized as result of the target 228 on the first shuttle 38-1 reaching their respective positions.

FIG. 15, as noted hereinabove, discloses a conventional basket-weave interlaced pattern 42-2 which may be formed on the circular loom 20 of the subject invention in place of the 5-harness interlaced weave pattern 42-1 shown in FIG. 11. In the basket-weave interlaced pattern 42-2 shown in FIG. 15, the weft ribbons 24 pass under and over alternative ones of the warp ribbons 22, and the warp ribbons similarly pass over and under alternate ones of the weft ribbons. In this regard, in FIG. 15, as was the case in FIG. 11, the weft ribbon portions passing under the warp ribbon portions are shown as shaded, and weft portions passing over warp ribbon portions are shown as unshaded. Further, it is apparent from FIG. 15 that in the basket-weave interlaced pattern 42-2 shown therein, the weave pattern repeats every other shuttle revolution, rather than every fifth revolution, as is the case in the 5-harness interlaced weave pattern 42-1 shown in FIG. 11.

Thus, it is apparent that the basket-weave interlaced pattern 42-2 shown in FIG. 15, can be formed using the three shuttles 38 and the warp ribbon-setting air cylinder control system 221 disclosed in FIGS. 12, 13 and 14. In this instance, however, the portion of the fabric 26 which can be formed before the sequencing of the warp ribbon-setting air cylinders 82 is repeated, can be accomplished in only two revolutions "R0" and "R1" of the shuttles 38, as indicated by the designations at the left-hand side of FIG. 15, rather than requiring five revolutions of the shuttle, as is the case in the forming of the 5-harness interlaced weave pattern fabric 42-1 shown in FIG. 11. Thus, in forming the basket-weave interlaced pattern 42-2 in FIG. 14, the steps 240, 242 and 244 in FIG. 14 can be eliminated.

In addition, any other desired interlaced fabric pattern, such is that known in the art as an 8-harness interlaced weave pattern, can be formed using the three shuttles 38 and the warp ribbon-setting control system 221 disclosed in FIGS. 12, 13 and 14. In this regard, an 8-harness interlaced weave pattern is one in which each weft ribbon 24 passes under one warp ribbon 22 and then over seven warp ribbons in a repetitive sequence, with each warp ribbon similarly passing over one weft ribbon and then over seven weft ribbons in a repetitive sequence. Thus, in forming the 8-harness interlaced weave pattern, eight revolutions of the three shuttles 38 are required to complete a fabric-forming sequence before the sequence is repeated, as compared to the five revolutions required for the 5-harness interlaced weave pattern 42-1 shown in FIG. 11, and the two revolutions required for forming the basket-weave interlaced pattern 42-2 shown in FIG. 15. Thus, with reference to FIG. 14, three additional shuttle revolution-determining steps would be required in addition to the steps 236-244, in order to form the 8-harness interlaced weave pattern. In addition, it will be apparent to those skilled in the art that when more or less than three shuttles 38 are used in a fabric-forming operation, the warp ribbon-setting control system 221 as disclosed in FIGS. 12, 13 and 14 still can be utilized, with minor modifications.

FIG. 16 illustrates a manner in which the control of the warp ribbon-setting air cylinders 82 (FIG. 3B) readily can be changed to selectively form the 5-harness interlaced weave pattern 42-1 shown in FIG. 11, the basket-weave interlaced pattern 42-2 shown in FIG. 15, the abovementioned 8-harness interlaced weave pattern (not shown), or any other desired weave pattern. In this regard, a computer 252 is preloaded with separate programs 254, 256 and 258 for the 5-harness interlaced weave pattern 42-1, the basket-weave interlaced pattern 42-2 and the abovementioned 8-harness interlaced weave pattern (not shown), respectively, and the control console 80 is provided with respective switches 260, 262 and 264 for each of the interlaced weave patterns. Accordingly, by actuating one of the switches 260, 262 or 264 on the control console 80, depending upon which of the interlaced-weave patterns is desired, the circular loom 20 readily can be changed from the weaving of one of the weave patterns 42 to one of the other weave patterns, in an apparent manner. In this connection, regardless of which of the switches 260, 262 or 264 and weave pattern programs 254, 256 or 258 is selected, the computer 252 can be used to control the warp ribbon-setting air cylinders 82 in the arc segments 222A-L, as above-described.

In summary, a new and improved circular loom, such as the circular loom 20, for weaving warp and weft to form a fabric, such as the fabric 26, has been disclosed.

The circular loom 20 includes the warp ribbon-setting control system 221 for detecting the position of the target 228 on the first shuttle 38-1 as the target passes the proximity switches 226, for sequentially presetting the warp ribbon-setting air cylinders 82 in the arc segments 222A–L between and in advance of the respective shuttle assemblies 38, to increase the speed at which the loom can be operated. In addition, the shuttles 38 are driven in a precise manner by the spur gears 108 and the pinion gears 110, from the motor 124, which is mounted independently of the shuttles 38, to form the fabric 26 in a uniform and precise manner. Further, the tension in the weft ribbons 24 is controlled by the electrical brakes 130 on the shuttles 38, and the tension in the warp ribbons 22 is controlled by the electrical brakes 66 on the warp ribbon supply reels 34, in a uniform manner. Each of the shuttles 38 also includes the weft-break detector mechanism 138, and the guide mechanism rollers 146 for turning the plane of the weft ribbon 24 from perpendicular to the circular path on the support table, to parallel thereto, as the weft travels from the shuttle to the fabric-forming ring member 154 in the fabric-forming position 46. At the fabric-forming position 46, each weft ribbon 24 becomes disposed in the warp shed 40 and slides transversely under the fabric-forming ring 154 with the longitudinally moving warp ribbons 22 of the warp shed and into the plane of the formed fabric 26 in engagement with the annular inner surface of the ring vertical leg 154*v*, essentially without being twisted about a transverse axis of the weft. The formed fabric 26 then is pulled from the fabric-forming ring 154 by the fabric-pulling mechanism 50, the speed of which is synchronized with the speed of the shuttle assembly drive motor 124, by the trimming device 194, at a rate dependent upon the width of the weft ribbon 24. Further, prior to reaching the fabric-pulling mechanism 50, the tubular fabric is slit longitudinally by the cutting mechanism 52, and after leaving the fabric-pulling mechanism, the fabric is wound upon the take-up reel 58 by the take-up mechanism 54, the speed of which is controlled so that the fabric is taken up in an essentially relaxed condition without any significant tension in the fabric. The circular loom 20 also readily can be converted from the manufacturing of one type of weave pattern 42 to another type of weave pattern, using the warp ribbon-setting control system 221 illustrated in FIGS. 12, 13 and 14, by preprogramming the computer 252 for each of the desired weave patterns, as illustrated in FIG. 16.

What is claimed is:

1. A circular loom for weaving warp and weft to form a fabric, which comprises:

a support table having a plurality of supplies of warp arranged around a periphery of the support table;

guide means for guiding warp ends from the warp supplies to a fabric-forming position;

warp shed-forming means arranged around the periphery of the support table for orienting the warp ends extending from the warp supplies to the fabric-forming position to form a series of successive warp sheds corresponding to a preselected weave pattern;

at least one shuttle assembly mounted for movement in a circular path on the support table through the warp sheds, the shuttle assembly comprising a supply of weft which is laid between the oriented warp ends in the fabric-forming position as the shuttle assembly travels about the table;

guide means for guiding the weft from the weft supply as the weft travels to the fabric-forming position;

drive means for rotating the shuttle assembly along the circular path; and control means for detecting the position of the shuttle assembly at periodic points along its path of travel and sequentially presetting banks of warp setting devices of the warp shed-forming means in advance of the shuttle assembly for subsequent passage of the shuttle assembly therethrough.

2. The circular loom as recited in claim 1, wherein the warp shed forming means comprises fluid cylinders which include extendable and retractable piston rods having warp guides mounted thereon.

3. The circular loom as recited in claim 2, wherein the fluid cylinder piston rods are extendable and retractable so as to form the warp sheds so that the shuttle assembly travels through the warp sheds without engaging the warp ends.

4. The circular loom as recited in claim 2, wherein the control means includes a plurality of solenoids for operating respective ones of the fluid cylinders, a plurality of solenoid sequencing circuits, one for each of a plurality of selectable weave patterns, and a plurality of selector switches, one for each of the solenoid sequencing circuits.

5. The circular loom as recited in claim 1, which further comprises:

a rotatable member forming part of the weft guide means on the shuttle assembly and about which the weft travels from the weft supply to the fabric-forming position; and electrical brake means for controlling the rotation of the rotatable member and tension in the weft.

6. The circular loom as recited in claim 5, which further comprises:

an electrical power supply; and means for providing a variable electrical voltage to the electrical brake means, the voltage providing means including a potentiometer, slip rings on the shuttle assembly electrically connected to the electrical brake means, and electrical brushes on the support table and engaged with the slip rings, the electrical brushes being connected to the electrical power supply through the potentiometer.

7. The circular loom as recited in claim 1, which further comprises:

electrical brake means on each of the warp supplies for controlling tension in each of the warp ends.

8. The circular loom as recited in claim 7, which further comprises:

an electrical power supply; and means for providing a variable electrical voltage to the electrical brake means on the warp supplies, the voltage providing means including a potentiometer through which the electrical brake means are connected to the power supply.

9. The circular loom as recited in claim 1, wherein the shuttle assembly drive means includes a spur gear extending about the periphery of the shuttle assembly, a plurality of pinion gears spaced around the periphery of the support table and engageable with the spur gear, and a motor mounted independently of the shuttle assembly and drivingly connected to the pinion gears.

10. The circular loom as recited in claim 1, which further comprises:

means for pulling the formed fabric continuously from the fabric-forming position;

first means for generating pulses in response to the speed of the fabric-pulling means;

second means for generating pulses in response to the speed of the shuttle assembly; and comparator means for comparing the pulses generated by the first and second pulse-generating means, and synchronizing the speed of the fabric-pulling means with the speed of the shuttle assembly.

11. The circular loom as recited in claim 10, wherein the weft is ribbon-shaped and the speed of the fabric-pulling means is synchronized with the speed of the shuttle assembly in a ratio dependent upon the width of the weft.

12. The circular loom as recited in claim 10, which further comprises:

cutter means between the fabric-forming position and the fabric-pulling means, for slitting the fabric.

13. The circular loom as recited in claim 10, which further comprises:

take-up means for taking up the formed fabric from the fabric-pulling means; and means for controlling the speed of the fabric take-up means so that the take-up means takes up the formed fabric in an essentially relaxed condition without any significant tension in the fabric.

14. The circular loom as recited in claim 1, wherein the weft is ribbon-shaped, the shuttle assembly travels about the support table on a circular track, and the weft guide means includes a first guide member around which the weft travels with a plane of the weft substantially perpendicular to the circular track, and further includes a second guide member disposed between the first guide member and the fabric-forming position for turning the weft so that the weft is laid between the warp ends of the warp shed in the fabric-forming position with a plane of the weft disposed substantially parallel to the circular track.

15. The circular loom as recited in claim 14, wherein the weft-turning guide member is one of a pair of opposed rollers through which the ribbon-shaped weft passes.

16. The circular loom as recited in claim 1, which further comprises:

a circular track on the support table on which the shuttle assembly travels about the support table;

an annular ring member mounted in the fabric-forming position, the annular ring member including a first portion which extends substantially parallel to the circular track, and a second inner side portion which extends substantially perpendicular to the circular track, the first and second ring portions being interconnected by a curved third ring portion, with the oriented warp ends of the warp sheds formed by the warp shed forming means initially engaging the first portion of the annular ring member and then traveling longitudinally about the curved and inner portions, and with the weft being laid between the oriented warp ends adjacent the first portion of the ring member and then sliding transversely with the warp ends about the first, curved and inner side portions of the ring member in forming of the fabric, essentially without any twist about a transverse axis of the weft.

17. The circular loom as recited in claim 16, wherein at least the weft is ribbon-shaped and the weft guide means includes a first guide member around which the weft travels with a plane of the weft substantially perpendicular to the circular track for the shuttle assembly, the weft guide means further including a second guide member disposed between the first guide member and the fabric forming-position for turning the weft so that the weft is initially laid between the oriented warp ends of the warp sheds in the fabric-forming position with the plane of the weft disposed substantially parallel to the circular track.

18. The circular loom as recited in claim 16, wherein the annular ring member is of right-angle construction in cross section, with the first ring portion being a radially outwardly extending leg and the inner side second ring portion being a second leg extending perpendicular to the first leg.

19. The circular loom as recited in claim 16, wherein the annular ring member is horizontally disposed and a fabric-pulling means is provided for pulling the formed fabric through the annular ring member.

20. The circular loom as recited in claim 1, which further comprises:

first roller means on one of the shuttle assembly or the support table adjacent inner and outer peripheries of the shuttle assembly, for supporting the shuttle assembly for rotation about the support table in the circular path; and second roller means on one of the shuttle assembly or the support table and cooperable with an annular retaining means on the other of the shuttle assembly or the support table, for preventing radial inward and/or outward movement of the rotating shuttle assembly.

21. The circular loom as recited in claim 20, wherein the annular retaining means is an annular groove in the shuttle assembly or the support table having a width corresponding to a diameter of rollers which define the second roller means.

22. The circular loom as recited in claim 1, wherein the shuttle assembly further comprises broken weft detector means for stopping the loom in the event of a broken weft, the detector means including an on-off switch in a loom operating circuit and a resiliently biased weft guide member movable to open the switch upon breaking of the weft.

23. The circular loom as recited in claim 1, which further comprises at least one additional shuttle assembly, and wherein the control means sequentially presets successive banks of warp setting devices of the warp shed-forming mechanism in advance of both shuttle assemblies for subsequent passage of the shuttle assemblies therethrough, in response to detection of the position of one of the shuttle assemblies.

24. The circular loom as recited in claim 1, which further comprises:

second control means for changing the preselected pattern of warp sheds formed by the warp shed-forming means, to a different pattern of warp sheds corresponding to a different selectable weave pattern.

25. A circular loom for weaving warp and weft to form a fabric, which comprises:

a support table having a plurality of supplies of warp arranged around a periphery of the support table;

guide means for guiding warp ends from the warp supplies to a fabric-forming position;

electrical brake means on each of the warp supplies for controlling tension in each of the warp ends;

warp shed forming means arranged around the periphery of the support table for orienting the warp ends extending from the warp supplies to the fabric-forming position to form a series of warp sheds corresponding to a preselected one of a plurality of selectable weave patterns, the warp shed forming means comprising fluid cylinders which include extendable and retractable piston rods having warp guides mounted thereon;

a plurality of shuttle assemblies mounted for movement on a circular track on the support table through the warp sheds, each shuttle assembly including a supply of ribbon-shaped weft which is laid between the oriented warp ends in the fabric-forming position as the shuttle assembly travels about the table, the warp shed forming fluid cylinder piston rods being expandable and retractable so as to form the warp sheds so that the shuttle assemblies travel through the warp sheds without engaging the warp ends;

separate guide means on each shuttle assembly for guiding the weft from each weft supply as the weft travels to the fabric-forming position;

an annular ring member mounted in the fabric-forming position, the annular ring member including a first portion which extends substantially parallel to the circular track for the shuttle assemblies, and an inner side second portion which extends substantially perpendicular to the circular track, the first and second ring portions being interconnected by a curved third portion, with the oriented warp ends of the warp sheds formed by the warp shed forming means initially engaging the first portion of the annular ring member and then traveling about the curved and inner side portions of the ring member through the ring member;

a first weft guide member forming part of the weft guide means for each weft supply and including electrical brake means for controlling tension in the weft;

a second weft guide member forming part of the weft guide means for each weft supply and about which the ribbon-shaped weft travels with a plane of the weft substantially perpendicular to the circular track for the shuttle assemblies, and from which the weft travels and turns so that the weft initially is laid between the oriented warp ends of the warp sheds in the fabric-forming position with the plane of the weft disposed substantially parallel to the circular track for the shuttle assemblies, the ribbon-shaped weft subsequently sliding transversely with the warp ends about the first, curved and inner side portions of the annular ring member in forming of the fabric, essentially without any twist about a transverse axis of the weft;

drive means for rotating the shuttle assemblies along the circular track and including a motor which is mounted independently of the shuttle assemblies and drivingly connected to the shuttle assemblies;

first control means for detecting the position of a first one of the shuttle assemblies at periodic points along its path of travel and sequentially presetting banks of warp setting devices of the warp shed-forming means in advance of each of the shuttle assemblies, in response to the position of the first shuttle assembly, the first control means including a plurality of solenoids for operating respective ones of the fluid cylinders; and second control means for changing the preselected pattern of warp sheds formed by the warp shed-forming means, to a different pattern of warp sheds corresponding to another of the selectable weave patterns, the second control means including a plurality of solenoid sequencing circuits, one for each of the selectable weave patterns, and a plurality of selector switches, one for each of the solenoid sequencing circuits.

26. The circular loom as recited in claim 25, wherein each weft guide means includes a weft-turning guide member on the respective shuttle assembly between the second guide member and the fabric-forming position.

27. The circular loom as recited in claim 26, wherein the weft-turning guide member is one of two opposed rollers through which the ribbon-shaped weft passes.

28. The circular loom as recited in claim 25, which further comprises:

means for pulling the formed fabric continuously from the fabric-forming position;

first means for generating pulses in response to the speed of the fabric-pulling means;

second means for generating pulses in response to the speed of the shuttle assemblies; and comparator means for comparing the pulses generated by the first and second pulse-generating means, and synchronizing the speed of the fabric-pulling means with the speed of the shuttle assemblies.

29. The circular loom as recited in claim 28, wherein the speed of the fabric-pulling means is synchronized with the speed of the shuttle assemblies in a ratio dependent upon the width of the ribbon-shaped weft.

30. The circular loom as recited in claim 28, which further comprises:

cutter means between the fabric-forming ring member means and the fabric-pulling means, for slitting the fabric.

31. The circular loom as recited in claim 28, which further comprises:

take-up means for taking up the formed fabric from the fabric-pulling means; and means for controlling the speed of the fabric take-up means so that the take-up means takes up the formed fabric in an essentially relaxed condition without any significant tension in the fabric.

32. A circular loom for weaving warp and weft to form a fabric, which comprises:

a support table having a plurality of supplies of warp arranged around a periphery of the support table;

guide means for guiding warp ends from the warp supplies to a fabric-forming position;

warp shed-forming means arranged around the periphery of the support table for orienting the warp ends extending from the warp supplies to the fabric-forming position to form a series of warp sheds corresponding to a preselected weave pattern, the warp shed-forming means comprising fluid cylinders having extendable and retractable piston rods having warp guides mounted thereon;

a shuttle assembly mounted for movement in a circular path on the support table through the warp sheds and carrying a supply of weft which is laid between the oriented warp ends in the fabric-forming position as the shuttle assembly travels about the table;

guide means on the shuttle assembly for guiding the weft from the weft supply as the weft travels to the fabric-forming position; and drive means for rotating the shuttle assembly along the circular path.

33. The circular loom as recited in claim 32, wherein the fluid cylinder piston rods are extendable and retractable so as to form the warp sheds so that the shuttle assembly travels through the warp sheds without engaging the warp ends.

34. The circular loom as recited in claim 32, wherein the warp ends are ribbon-shaped and each of the warp guides on the fluid cylinder piston rods is in the form of a transversely elongated loop.

35. A circular loom for weaving warp and weft to form a fabric, which comprises:

a support table having a plurality of supplies of warp arranged around a periphery of the support table;

guide means for guiding warp ends from the warp supplies to a fabric-forming position;

warp shed-forming means arranged around the periphery of the support table for orienting the warp ends extending from the warp supplies to the fabric-forming position to form a series of warp sheds corresponding to a preselected weave pattern;

a shuttle assembly mounted for movement in a circular path on the support table through the warp sheds and being adapted to carry a supply of weft which is laid between the oriented warp ends in the fabric-forming position as the shuttle assembly travels about the table;

guide means on the shuttle assembly for guiding the weft from the weft supply as the weft travels to the fabric-forming position;

a rotatable member forming part of the weft guide means on the shuttle assembly and about which the weft travels from the weft supply to the fabric-forming position;

electrical brake means for controlling the rotation of the rotatable member and tension in the weft; and drive means for rotating the shuttle assembly along the circular path.

36. The circular loom as recited in claim 35, wherein the shuttle assembly further comprises broken weft detector means for stopping the loom in the event of a broken weft, the detector means including an on-off switch in a loom operating circuit and a resiliently biased weft guide member movable to open the switch upon breaking of the weft.

37. The circular loom as recited in claim 35, which further comprises:

an electrical power supply; and means for providing a variable electrical voltage to the electrical brake means, the voltage providing means including a potentiometer, slip rings on the shuttle assembly electrically connected to the electrical brake means, and electrical brushes on the support table engaged with the slip rings, the electrical brushes being connected to the electrical power supply through the potentiometer.

38. The circular loom as recited in claim 35, which further comprises:

electrical brake means on the warp supplies for controlling tension in the warp ends.

39. The circular loom as recited in claim 38, which further comprises:

means for providing a variable electrical voltage to the electrical brake means on the warp supplies, the voltage providing means including a potentiometer through which the electrical brake means on the warp supplies are connected to the power supply.

40. A circular loom for weaving warp and weft to form a fabric, which comprises:

a support table having a plurality of supplies of warp arranged around a periphery of the support table;

guide means for guiding warp ends from the warp supplies to a fabric-forming position;

warp shed-forming means arranged around the periphery of the support table for orienting the warp ends extending from the warp supplies to the fabric-forming position to form a series of warp sheds corresponding to a preselected weave pattern;

a shuttle assembly mounted for movement in a circular path on the support table through the warp sheds and carrying a supply of weft which is laid between the oriented warp ends in the fabric-forming position as the shuttle assembly travels about the table;

guide means on the shuttle assembly for guiding the weft from the weft supply as the weft travels to the fabric-forming position;

drive means for rotating the shuttle assembly along the circular path, the drive means including a spur gear extending about the periphery of the shuttle assembly, a plurality of pinion gears spaced around the periphery of the support table and engageable with the spur gear, and a motor mounted independently of the shuttle assembly and drivingly connected to the pinion gears;

first roller means on one of the shuttle assembly or the support table adjacent inner and outer peripheries of the shuttle assembly, for supporting the shuttle assembly for rotation about the support table in the circular path; and second roller means on one of the shuttle assembly or the support table and cooperable with an annular retaining means on the other of the shuttle assembly or the support table, for preventing radial inward and/or outward movement of the rotating shuttle assembly.

41. The circular loom as recited in claim 40, wherein the annular retaining means is an annular groove in the shuttle assembly or the support table having a width corresponding to a diameter of rollers which define the second roller means.

42. A circular loom for weaving warp and weft to form a fabric, which comprises:

a support table having a plurality of supplies of warp arranged around a periphery of the support table;

guide means for guiding warp ends from the warp supplies to a fabric-forming position;

warp shed-forming means arranged around the periphery of the support table for orienting the warp ends extending from the warp supplies to the fabric-forming position to form a series of warp sheds corresponding to a preselected weave pattern;

a shuttle assembly mounted for movement in a circular path on the support table through the warp sheds and carrying a supply of weft which is laid between the oriented warp ends in the fabric-forming position as the shuttle assembly travels about the table;

guide means on the shuttle assembly for guiding the weft from the weft supply as the weft travels to the fabric-forming position;

drive means for rotating the shuttle assembly along the circular path;

means for pulling the formed fabric from the fabric-forming position;

first means for generating pulses in response to the speed of the fabric-pulling means;

second means for generating pulses in response to the speed of the shuttle assembly; and comparator means for comparing the pulses generated by the first and second pulse generating means, and synchronizing the speed of the fabric-pulling means with the speed of the shuttle assembly.

43. The circular loom as recited in claim 42, wherein the weft is ribbon-shaped and the speed of the fabric-pulling means is synchronized with the speed of the shuttle assembly in a ratio dependent upon the width of the weft.

44. The circular loom as recited in claim 42, which further comprises:

cutter means between the fabric-forming position and the fabric-pulling means, for slitting the fabric.

45. The circular loom as recited in claim 42, which further comprises:

take-up means for taking up the formed fabric from the fabric-pulling means; and means for controlling the speed of the fabric take-up means so that the take-up means takes up the formed fabric in an essentially relaxed condition without any significant tension in the fabric.

46. A circular loom for weaving warp and weft to form a fabric, which comprises:

a support table having a plurality of supplies of warp arranged around a periphery of the support table;

guide means for guiding warp ends from the warp supplies to a fabric-forming position;

warp shed forming means arranged around the periphery of the support table for orienting the warp ends extending from the warp supplies to the fabric-forming position to form a series of warp sheds corresponding to a preselected weave pattern;

a shuttle assembly mounted for movement on a circular track on the support table through the warp sheds and carrying a supply of ribbon-shaped weft which is laid between the oriented warp ends in the fabric-forming position as the shuttle assembly travels about the table;

guide means on the shuttle assembly for guiding the ribbon-shaped weft from the weft supply as the weft travels to the fabric-forming position, the weft guide means including a first guide member around which the weft travels with a plane of the weft substantially perpendicular to the circular track for the shuttle assembly, and further includes a second guide member disposed between the first guide member and the fabric-forming position for turning the weft so that the weft is laid between the oriented warp ends of the warp shed in the fabric-forming position with a plane of the weft disposed substantially parallel to the circular track; and drive means for rotating the shuttle assembly along the circular track.

47. The circular loom as recited in claim 46, wherein the weft-turning guide member is one of a pair of opposed rollers through which the ribbon-shaped weft passes.

48. A circular loom for weaving warp and weft to form a fabric, which comprises:

a support table having a plurality of supplies of warp arranged around a periphery of the support table;

guide means for guiding warp ends from the warp supplies to a fabric-forming position;

warp shed forming means arranged around the periphery of the support table for orienting the warp ends extending from the warp supplies to the fabric-forming position to form a series of warp sheds corresponding to a preselected weave pattern;

a shuttle assembly mounted for movement on a circular track on the support table through the warp sheds and carrying a supply of weft which is laid between the oriented warp ends in the fabric-forming position as the shuttle assembly travels about the table;

guide means on the shuttle assembly for guiding the weft from the weft supply as the weft travels to the fabric-forming position;

an annular ring member mounted in the fabric-forming position, the annular ring member including a first portion which extends substantially parallel to the circular track, and an inner side second portion which extends substantially perpendicular to the circular track, the first and second ring portions being interconnected by a curved third ring portion, with the oriented warp ends of the warp sheds formed by the warp shed forming means both initially engaging the first side portion of the annular ring member, and then traveling about the curved and inner side portions of the ring member through the ring member, and with the weft being laid between the warp oriented ends adjacent the first portion of the ring member and then sliding transversely with the warp ends about the first, curved and inner side portions of the ring member in forming of the fabric, essentially without any twist about a transverse axis of the weft; and drive means for rotating the shuttle assembly along the circular track on the support table.

49. The circular loom as recited in claim 48, wherein the weft is ribbon-shaped and the weft guide means on the shuttle assembly includes a first guide member around which the weft travels with a plane of the weft substantially perpendicular to the circular track for the shuttle assembly, the weft guide means further including a second guide member disposed between the first guide member and the fabric-forming position for turning the weft so that the weft is initially laid between the oriented warp ends of the warp sheds in the fabric-forming position with the plane of the weft disposed substantially parallel to the circular track for the shuttle assembly.

50. The circular loom as recited in claim 49, wherein the annular ring member is horizontally disposed and a fabric pulling means is provided for pulling the formed fabric through the annular ring member.

51. The circular loom as recited in claim 49, wherein the annular ring member is of right-angle construction in cross section, with the first ring portion being a radially outwardly extending leg and the inner side second ring portion being a leg extending perpendicular to the first leg.

52. A circular loom for weaving warp and weft to form a fabric, which comprises:

a support table having a plurality of supplies of warp arranged around a periphery of the support table;

guide means for guiding warp ends from the warp supplies to a fabric-forming position;

warp shed forming means arranged around the periphery of the support table for orienting the warp ends extending from the warp supplies to the fabric-forming position to form a series of successive warp sheds corresponding to a preselected one of a plurality of selectable weave patterns, the warp shed forming means comprising fluid cylinders which include extendable and retractable piston rods having warp guides mounted thereon;

a shuttle assembly mounted for movement in a circular path on the support table through the warp sheds and carrying a supply of weft which is laid between the oriented warp ends in the fabric-forming position as the shuttle assembly travels about the table;

guide means on the shuttle assembly for guiding the weft from the weft supply as the weft travels to the fabric-forming position;

drive means for rotating the shuttle assembly along the circular path; and control means for changing the preselected pattern of warp sheds formed by the warp shed forming means, to a different pattern of warp sheds corresponding to another of the selectable weave patterns.

53. The circular loom as recited in claim 52, wherein the control means includes a plurality of solenoids for operating respective ones of the fluid cylinders, a plurality of solenoid sequencing circuits, one for each of the plurality of selectable weave patterns, and a plurality of selector switches, one for each of the solenoid sequencing circuits.

54. A method of weaving warp and weft to form a fabric, which comprises the steps of:

arranging a plurality of banks of warp ends along a circular path to form a warp shed;

rotating at least one shuttle assembly, including a supply of weft, along the circular path through the warp shed formed by the banks of warp ends;

detecting the position of the shuttle assembly at periodic points along the circular path; and sequentially modifying successive banks of the warp ends in response to the detection of the shuttle assembly at the periodic points along the circular path, to change the configuration of the warp shed in advance of the shuttle assembly for passage of the shuttle assembly through the warp shed.

55. The method as recited in claim 54, which further comprises the additional steps of:

rotating at least one additional shuttle assembly, including an additional supply of weft, along the circular path; and sequentially modifying successive banks of the warp ends in response to the detection of the one shuttle assembly at the periodic points along the circular path, to change the configuration of the warp shed in advance of the additional shuttle assembly for passage of the additional shuttle assembly through the warp shed.

56. The method as recited in claim 54, wherein at least the weft is ribbon-shaped, and which comprises the additional steps of:

providing a ring-shaped fabric-forming member in a fabric-forming position;

extending the banks of warp ends to the fabric-forming member;

feeding the ribbon-shaped weft toward the fabric-forming member from the weft supply with the plane of the weft perpendicular to the circular path of the weft supply;

turning the ribbon-shaped weft 90° into a position in which the plane of the weft is parallel to the circular path as the weft becomes disposed adjacent the fabric-forming member;

causing the fabric to travel continuously through the fabric-forming member so that the warp ends travel about portions of the fabric-forming member, including an inner side thereof, and so that the ribbon-shaped weft travels with the warp ends with a transverse sliding movement about the portions of the fabric-forming member, essentially without any twist about a transverse axis of the weft; and synchronizing the speed of continuous travel of the formed fabric through the fabric-forming member with the speed of the shuttle assembly and the weft supply about the fabric-forming member at a ratio dependent on the width of the ribbon-shaped weft.

57. A method of weaving warp and weft to form a fabric, wherein at least the weft is ribbon-shaped, which comprises the steps of:

providing a ring-shaped fabric-forming member in a fabric-forming position;

orienting warp ends to form a series of successive warp sheds corresponding to a preselected weave pattern and extending to the fabric-forming member;

rotating a supply of the ribbon-shaped weft along a circular path about the fabric-forming member and through the warp sheds so that the ribbon-shaped weft feeds from the supply and becomes disposed adjacent the fabric-forming member between opposed portions of the warp ends with a plane of the weft parallel to the circular path and so that the weft becomes interlaced with the warp ends to form the fabric; and causing the fabric to travel continuously through the fabric-forming member so that the warp ends travel in unison about portions of the fabric-forming member, including a radially extending portion and an inner side portion thereof, and so that the ribbon-shaped weft travels with the warp ends with a transverse sliding movement about the portions of the fabric-forming member, essentially without any twist about a transverse axis of the weft.

58. The method as recited in claim 57, which further comprises the step of:

feeding the ribbon-shaped weft toward the fabric-forming member from the weft supply with the plane of the weft perpendicular to the circular path of the weft supply; and turning the ribbon-shaped weft 90° into the position in which the plane of the weft is parallel to the circular path as the weft becomes disposed adjacent the fabric-forming member.

59. The method as recited in claim 57, which further comprises the step of:

synchronizing the speed of continuous travel of the formed fabric through the fabric-forming member with the speed of the warp supply about the fabric-forming member at a ratio dependent upon the width of the ribbon-shaped weft.

60. The method as recited in claim 57, which further comprises the step of:

taking up the formed fabric in an essentially relaxed condition without any significant tension in the fabric.

61. A circular loom for weaving warp and weft to form a fabric, which comprises:

a support table adapted to have a plurality of supplies of warp arranged around the support table;

warp shed-forming means for orienting warp ends extending from the warp supplies to a fabric-forming position relative to one another to form a series of successive warp sheds corresponding to a preselected weave pattern;

at least one shuttle assembly mounted for movement in a circular path on the support table through the warp sheds, the shuttle assembly comprising a supply of weft which is interlaced with the oriented warp ends in the fabric-forming position as the shuttle assembly travels about the table; and means responsive to the position of the shuttle assembly on the support table for presetting the warp shed-forming means for passage of the shuttle assembly therethrough.

62. A circular loom for weaving warp and weft to form a fabric, which comprises:

a support table adapted to have a plurality of supplies of warp arranged around the support table;

warp shed-forming means for orienting warp ends extending from the warp supplies to a fabric-forming position relative to one another to form a series of warp sheds corresponding to a preselected weave pattern, the warp shed-forming means comprising warp guides and fluid cylinders for operating respective ones of the warp guides; and a shuttle assembly mounted for movement in a circular path on the support table through the warp sheds and carrying a supply of weft which is interlaced with the oriented warp ends in the fabric-forming position as the shuttle assembly travels about the table.

63. A circular loom for weaving warp and weft to form a fabric, which comprises:

a support table adapted to have a plurality of supplies of warp arranged around the support table;

warp shed-forming means for orienting warp ends extending from the warp supplies to a fabric-forming position relative to one another to form a series of warp sheds corresponding to a preselected weave pattern;

a shuttle assembly mounted for movement in a circular path on the support table through the warp sheds and being adapted to carry a supply of weft which is interlaced with the oriented warp ends in the fabric-forming position as the shuttle assembly travels about the table; and electrical brake means on the shuttle assembly for controlling tension in the weft.

64. A circular loom for weaving warp and weft to form a fabric, which comprises:

a support table adapted to have a plurality of supplies of warp arranged around the support table;

warp shed-forming means for orienting warp ends extending from the warp supplies to a fabric-forming position relative to one another to form a series of warp sheds corresponding to a preselected weave pattern;

a shuttle assembly mounted for movement in a circular path on the support table through the warp sheds and carrying a supply of weft which is interlaced with the oriented warp ends in the fabric-forming position as the shuttle assembly travels about the table;

first and second roller means on one of the shuttle assembly of the support table adjacent inner and outer peripheries, respectively, of the shuttle assembly, for supporting the shuttle assembly for rotation about the support table in the circular path; and third roller means on one of the shuttle assembly or the support table intermediate the first and second roller means and cooperable with an annular retaining groove in an intermediate portion of the other of the shuttle assembly or the support table, for preventing radial inward and/or outward movement of the rotating shuttle assembly.

65. A circular loom for weaving warp and weft to form a fabric, which comprises:

a support table adapted to have a plurality of supplies of warp arranged around the support table;

warp shed-forming means for orienting warp ends extending from the warp supplies to a fabric-forming position to form a series of warp sheds corresponding to a preselected weave pattern;

a shuttle assembly mounted for movement in a circular path on the support table through the warp sheds and carrying a supply of weft which is interlaced with the oriented warp ends in the fabric-forming position as the shuttle assembly travels about the table;

a plurality of first cylindrical rollers on one of the shuttle assembly or the support table adjacent both inner and outer peripheries of the shuttle assembly, the cylindrical rollers being mounted for rotation about axes extending parallel to the support table for supporting the shuttle assembly for rotation about the support table in the circular path; and a plurality of second cylindrical rollers on one of the shuttle assembly or the support table, the second cylindrical rollers being rotatable about axes entering perpendicular to the support table and cooperable with an annular retaining groove in the other of the shuttle assembly or the support table, for preventing radial inward and outward movement of the rotating shuttle assembly.

66. A circular loom for weaving warp and weft to form a fabric, which comprises:

a support table adapted to have a plurality of supplies of warp arranged around the support table;

warp shed-forming means for orienting warp ends extending from the warp supplies to a fabric-forming position relative to one another to form a series of warp sheds corresponding to a preselected weave pattern;

a shuttle assembly mounted for movement in a circular path on the support table through the warp sheds and carrying a supply of weft which is interlaced with the oriented warp ends in the fabric-forming position as the shuttle assembly travels about the table; and cylindrical rollers on one of the shuttle assembly or the support table, the cylindrical rollers being rotatable about axes extending perpendicular to the support table and being cooperable with an annular retaining groove in the other of the shuttle assembly or the support table, for preventing radial inward and/or outward movement of the rotating shuttle assembly.

67. A circular loom for weaving warp and weft to form a fabric, which comprises:

a support table adapted to have a plurality of supplies of warp arranged around the support table;

warp shed-forming means for orienting warp ends extending from the warp supplies to a fabric-forming position relative to one another to form a series of warp sheds corresponding to a preselected weave pattern;

a shuttle assembly mounted for movement in a circular path on the support table through the warp sheds and carrying a supply of weft which is interlaced with the oriented warp ends in the fabric-forming position as the shuttle assembly travels about the table;

means for pulling the formed fabric from the fabric-forming position; and comparator means for synchronizing the speed of the fabric-pulling means with the speed of the shuttle assembly.

68. A circular loom for weaving warp and weft to form a fabric, which comprises:

a support table adapted to have a plurality of supplies of warp arranged around the support table;

warp shed forming means for orienting warp ends extending from the warp supplies to a fabric-forming position relative to one another to form a series of warp sheds corresponding to a preselected weave pattern;

a shuttle assembly mounted for movement on a circular track on the support table through the warp sheds and carrying a supply of ribbon-shaped weft which is interlaced with the oriented warp ends in the fabric-forming position as the shuttle assembly travels about the table; and guide roller means on the shuttle assembly for engaging at least one planar surface of the ribbon-shaped weft and guiding the ribbon-shaped weft from the weft supply so that the weft is laid between the oriented warp ends of the warp shed in the fabric-forming position with the planar surface of the weft disposed substantially parallel to the circular track.

69. A circular loom for weaving warp and weft to form a fabric, which comprises:

a support table adapted to have a plurality of supplies of warp arranged around the support table;

warp shed forming means for orienting warp ends extending from the warp supplies to a fabric-forming position to form a series of warp sheds corresponding to a preselected weave pattern;

a shuttle assembly mounted for movement on a circular track on the support table through the warp sheds and carrying a supply of weft which is interlaced with the oriented warp ends in the fabric-forming position as the shuttle assembly travels about the table;

means for laying the weft between the oriented warp ends in the fabric forming position so that the weft becomes interlaced with the warp ends to form the fabric;

take-up means for taking up the formed fabric; and ring-shaped guide means in the fabric-forming position for guiding the formed fabric, the ring-shaped guide means including a surface portion which extends substantially parallel to the circular track, with the oriented warp ends of the warp sheds formed by the warp shed forming means both initially engaging the surface portion and with the formed fabric then traveling through the ring-shaped guide means.

70. The circular loom as recited in claim 69, wherein the oriented warp ends pass partially around and then through the ring-shaped guide means radially inward thereof.

71. The circular loom as recited in claim 69, wherein:

said weft laying means lays the weft between the oriented warp ends radially outward of the surface portion of the ring-shaped guide means so that the weft slides transversely with the warp ends in forming of the fabric, essentially without any twist about a transverse axis of the weft.

72. The circular loom as recited in claim 69, wherein the weft laying means lays the weft between the oriented warp ends radially outward of the ring-shaped guide means.

73. A circular loom for weaving warp and weft to form a fabric, which comprises:

a support table adapted to have a plurality of supplies of warp arranged around the support table;

warp shed forming means for orienting warp ends extending from the warp supplies to a fabric-forming position to form a series of warp sheds corresponding to a preselected weave pattern;

a shuttle assembly mounted for movement on a circular track on the support table through the warp sheds and carrying a supply of ribbon-shaped weft which is interlaced with the oriented warp ends in the fabric-forming position as the shuttle assembly travels about the table;

ring-shaped guide means for guiding the warp and weft in the fabric-forming position, the ring-shaped guide means including a surface portion which extends substantially parallel to the circular track; and means for guiding the ribbon-shaped weft from the weft supply so that the weft becomes disposed adjacent the surface portion of the ring-shaped guide means essentially parallel to the surface portion and then slides transversely about the surface portion in forming of the fabric, essentially without any twist about a transverse axis of the weft.

74. A method of weaving warp and weft to form a fabric, which comprises the steps of:

arranging a plurality of warp ends along a circular path;

rotating at least one shuttle assembly, including a supply of weft, along the circular path through successive positions;

orienting the warp ends to form a series of successive warp sheds corresponding to a preselected weave pattern; and presetting the warp ends in response to the position of the shuttle assembly, to change the configuration of the warp sheds for passage of the shuttle assembly therethrough.

75. A method of weaving warp and weft to form a fabric, which comprises the steps of:

providing a ring-shaped guide means for guiding the warp and weft in a fabric forming position;

orienting warp ends to form a series of successive warp sheds corresponding to a preselected weave pattern and extending to the ring-shaped guide means;

rotating a supply of the weft along a circular path about the ring-shaped guide means and through the warp sheds so that the weft becomes interlaced with the warp ends adjacent the ring-shaped guide means to form the fabric;

guiding the warp ends to a surface portion of the ring-shaped guide means which extends substantially parallel to the circular track so that the warp ends both initially engage the surface portion, and then guiding the fabric formed by the interlaced warp ends and weft partially around and through the ring-shaped guide means; and taking up the formed fabric from the ring-shaped guide means.

76. The method as recited in claim 75, wherein the weft travels partially around and then through the ring-shaped guide means radially inward thereof.

77. The method as recited in claim 75, which further comprises the step of:

guiding the weft from the weft supply to a position radially outward of the surface portion of the ring-shaped guide means so that the weft becomes laid between the oriented warp ends and travels with the warp ends through the ring-shaped guide means with a transverse sliding movement, essentially without any twist about a transverse axis of the weft.

78. The method as recited in claim 77, wherein the weft is guided to a position radially outward of the ring-shaped guide means.

79. A method of weaving warp and weft to form a fabric, wherein at least the weft is ribbon-shaped, which comprises the steps of:

providing a ring-shaped guide means for guiding the warp and weft in a fabric-forming position;

orienting warp ends to form a series of successive warp sheds corresponding to a preselected weave pattern and extending to the ring-shaped guide means;

rotating a supply of the ribbon-shaped weft along a circular path about the ring-shaped guide means and through the warp sheds so that the ribbon-shaped weft feeds from the supply and becomes disposed adjacent the ring-shaped guide means with a plane of the weft parallel to the circular path and so that the weft becomes interlaced with the warp ends to form the fabric; and causing the fabric to travel continuously through the ring-shaped guide means so that the ribbon-shaped weft travels with a transverse sliding movement about a surface portion of the ring-shaped guide means, essentially without any twist about a transverse axis of the weft.

80. A circular loom for weaving warp and weft to form a fabric, which comprises:

a support table adapted to have a plurality of supplies of warp arranged around the support table;

warp shed-forming means for orienting warp ends extending from the warp supplies to a fabric-forming position to form a series of warp sheds corresponding to a preselected weave pattern;

a shuttle assembly mounted for movement in a circular path on the support table through the warp sheds and carrying a supply of weft which is interlaced with the oriented warp ends in the fabric-forming position as the shuttle assembly travels about the table;

take-up means for taking up the formed fabric, the take-up means including a take-up drive motor and a take-up reel; and means for controlling the speed of the fabric take-up means so that the take-up means takes up the formed fabric in an essentially relaxed condition on the take-up reel without any significant tension in the fabric, said control means comprising an electromagnetic clutch disposed between the take-up drive motor and the take-up reel of the take-up means.

81. The circular loom as recited in claim 80, wherein said control means further comprises means for adjusting a voltage applied to said electromagnetic clutch.

82. A circular loom for weaving warp and weft to form a fabric, which comprises:

a support table adapted to have a plurality of supplies of warp arranged around the support table;

warp shed-forming means for orienting warp ends extending from the warp supplies to a fabric-forming position to form a series of warp sheds corresponding to a preselected weave pattern;

a shuttle assembly mounted for movement in a circular path on the support table through the warp sheds and being adapted to carry a supply of weft which is interlaced with the oriented warp ends in the fabric-forming position as the shuttle assembly travels down the table; and broken weft detector means for stopping the loom in the event of breakage of the weft, the detector means including a switch mounted on the shuttle assembly and forming a part of a loom operating circuit, and further comprising a means also mounted on the shuttle assembly for immediately operating the switch and stopping the loom in response to breaking of the weft.

83. A method of weaving warp and weft to form a fabric, wherein at least the weft is ribbon-shaped, which comprises the steps of:

providing a ring-shaped fabric-forming member in a fabric-forming position;

orienting warp ends to form a series of successive warp sheds corresponding to a preselected weave pattern and extending to the fabric-forming member;

rotating a supply of the ribbon-shaped weft along a circular path about the fabric-forming member and through the warp sheds so that the ribbon-shaped weft feeds from the supply and becomes disposed adjacent the fabric-forming member with a plane of the weft parallel to the circular path and so that the weft becomes interlaced with the warp ends to form the fabric; and causing the fabric to travel continuously through the fabric-forming member so that the warp ends travel about portions of the fabric forming member, including an inner side portion thereof, and so that the ribbon-shaped weft travels with the warp ends with a transverse sliding movement about the portions of the fabric-forming member, essentially without any twist about a transverse axis of the weft;

engaging the warp ends with guides on piston rods of respective fluid cylinders; and selectively extending and retracting the fluid cylinder piston rods in a predetermined sequence to orient the warp ends and to form the series of successive warp sheds in accordance with the preselected weave pattern.

84. A method of weaving warp and weft to form a fabric, wherein at least the weft is ribbon-shaped, which comprises the steps of:

providing a ring-shaped fabric-forming member in a fabric-forming position;

orienting warp ends to form a series of successive warp sheds corresponding to a preselected weave pattern and extending to the fabric-forming member;

rotating a supply of the ribbon-shaped weft along a circular path about the fabric-forming member and through the warp sheds so that the ribbon-shaped weft fees from the supply and becomes disposed adjacent the fabric-forming member with a plane of the weft parallel to the circular path and so that the weft becomes interlaced with the warp ends to form the fabric; and causing the fabric to travel continuously through the fabric-forming member so that the warp ends travel about portions of the fabric-forming member, including an inner side portion thereof, and so that the ribbon-shaped weft travels with the warp ends with a transverse sliding movement about the portions of the fabric-forming member, essentially without any twist about a transverse axis of the weft;

engaging the warp ends with guides on piston rods of respective fluid cylinders;

selectively advancing and retracting the fluid cylinder piston rods in a predetermined sequence to orient the warp ends and to form the series of successive warp sheds in accordance with the preselected weave pattern;

feeding the ribbon-shaped weft toward the fabric-forming member from the weft supply with the plane of the weft perpendicular to the circular path of the weft supply;

turning the ribbon-shaped weft 90° into the position in which the plane of the weft is parallel to the circular path as the weft becomes disposed adjacent the fabric-forming member;

synchronizing the speed of continuous travel of the formed fabric through the fabric-forming member with the speed of the shuttle assembly and the weft supply about the fabric-forming member at a ratio dependent upon the width of the ribbon-shaped weft; and taking up the formed fabric in an essentially relaxed condition without any significant tension in the fabric.

85. A loom for weaving warp and weft into a fabric, which comprises:

means for supporting a plurality of supplies of warp adjacent a fabric-forming position;

means for orienting warp ends extending from the warp supplies to the fabric-forming position relative to one another to form a series of successive warp sheds corresponding to a preselected weave pattern;

movable shuttle means for moving the weft through the successive warp sheds;

detecting means for detecting the position of the moving shuttle means; and means for presetting the warp shed-forming means in response to the detecting means, so as to form the successive warp sheds in advance of the moving shuttle means for passage of the shuttle means through the warp sheds.

86. The loom as recited in claim 85, wherein the warp shed-forming means comprises fluid cylinders which include extendable and retractable piston rods having warp guides mounted thereon.

87. The loom as recited in claim 85, which further comprises electrical brake means for maintaining back tension in the warp ends.

88. The loom as recited in claim 85, which further comprises:

means for pulling the fabric from the fabric-forming position; and means for synchronizing the fabric-pulling means with the movement of the shuttle means.

89. The loom as recited in claim 88, wherein the weft is ribbon-shaped and which further comprises means for synchronizing the pulling of the fabric by the fabric-pulling means with the movement of the shuttle means in a ratio dependent upon the width of the weft.

90. The loom as recited in claim 88, which further comprises:

take-up means for taking up the formed fabric from the fabric-pulling means; and means for controlling the speed of the fabric take-up means so that the take-up means takes up the formed fabric in an essentially relaxed condition without any significant tension in the fabric.

91. The loom as recited in claim 85, which further comprises broken weft detector means for stopping the loom in the event of breakage of the weft, the detector means including a switch mounted on the shuttle means and forming part of a loom operating circuit, and further comprising a means also mounted on the shuttle means for immediately operating the switch and stopping the loom in response to breaking of the weft.

* * * * *